US007813669B2

(12) United States Patent
Matsumoto et al.

(10) Patent No.: US 7,813,669 B2
(45) Date of Patent: Oct. 12, 2010

(54) IMAGE FORMING APPARATUS

(75) Inventors: Kazuyoshi Matsumoto, Tokyo (JP); Junichi Murano, Saitama (JP); Hirofumi Sugane, Kanagawa (JP); Yuki Satoh, Tokyo (JP); Toshiyuki Mae, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 700 days.

(21) Appl. No.: 11/617,896

(22) Filed: Dec. 29, 2006

(65) Prior Publication Data

US 2007/0160383 A1 Jul. 12, 2007

(30) Foreign Application Priority Data

Jan. 6, 2006 (JP) ..... 2006-001721

(51) Int. Cl.
*G03G 15/00* (2006.01)

(52) U.S. Cl. ..... 399/110; 399/117; 399/111

(58) Field of Classification Search ..... 399/113, 399/110, 391, 393
See application file for complete search history.

(56) References Cited

U.S. PATENT DOCUMENTS

| | | | | |
|---|---|---|---|---|
| 6,571,073 | B1 | 5/2003 | Suzuki et al. | |
| 7,106,990 | B2 | 9/2006 | Murano et al. | |
| 2005/0008393 | A1 * | 1/2005 | Kuma et al. | 399/110 |
| 2005/0047825 | A1 | 3/2005 | Nakano et al. | |
| 2006/0210305 | A1 | 9/2006 | Murano et al. | |
| 2007/0002122 | A1 | 1/2007 | Murano et al. | |

FOREIGN PATENT DOCUMENTS

| | | | |
|---|---|---|---|
| EP | 0 919 885 | A2 | 6/1999 |
| EP | 1 207 437 | A2 | 5/2002 |
| EP | 1 298 502 | A1 | 4/2003 |
| EP | 1 703 340 | A1 | 9/2006 |
| JP | 3-044653 | | 2/1991 |
| JP | 10-7260 | | 1/1998 |
| JP | 2000-79739 | | 3/2000 |
| JP | 3040525 | | 3/2000 |
| JP | 2001-222207 | | 8/2001 |
| JP | 2001-242671 | | 9/2001 |
| JP | 2004-177443 | | 6/2004 |
| JP | 2004-233902 | | 8/2004 |
| JP | 2004-246000 | | 9/2004 |

* cited by examiner

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

An operation lever is configured to swing about a rotation axis. Regulating members that regulate the movement of the operation lever along the rotation axis thereof are integrally formed with a cover.

10 Claims, 30 Drawing Sheets

IMAGE FORMING APPARATUS

CROSS-REFERENCE TO RELATED APPLICATIONS

The present document incorporates by reference the entire contents of Japanese priority document, 2006-001721 filed in Japan on Jan. 6, 2006.

BACKGROUND OF THE INVENTION

1. Field of the Invention

The present invention relates to a technology for positioning image carrier units in an image forming apparatus.

2. Description of the Related Art

Image forming apparatuses including copying machines such as electrophotographic copying machines, facsimile machines, printers, plotters, and multifunction products having the functions of two or more of these machines have been known.

In such an image forming apparatus, particularly in a multicolor image forming apparatus including a plurality of image carriers, it has been an important issue to accurately position a plurality of image carrier units (process cartridges) to be mounted on an image forming apparatus, so that images are prevented from being out of alignment including alignment of colors. The image carrier units each include an image carrier or the like that is a photosensitive member in a form of, for example, a drum (hereinafter, "photosensitive drum") and also are configured to be attachable to and detachable from the image forming apparatus. Against this background, for example, Japanese Patent Application Laid-open Nos. H04-229889, 2004-177443, H10-7260, 2004-233902, 2001-242671, and 2001-222207 have proposed various methods for accurately positioning the image carrier units, and some of these methods are in practical use.

However, the above conventional techniques have problems in that the operability is low, for example, the operation to attach and detach a positioning member is complicated or difficult, and the cost is high.

In Japanese Patent Application No. 2005-332015 (Patent Application filed on Nov. 16, 2005), the applicant of the present application proposed a technique related to an image forming apparatus and the like that is able to solve the problems stated above.

However, it has become clear that the technique (first to third comparative examples explained later) disclosed in Japanese Patent Application No. 2005-332015 has some problems and need to be improved before practically utilized.

The problems will be explained with reference to FIGS. 8 to 11, 17, 30, and 31 in which the second comparative example, explained later, is shown. Referring to FIGS. 8 to 11, an image forming apparatus 7 includes process cartridges (image carrier units) 1Y, 1C, 1M, and 1BK. Each of the process cartridges 1Y, 1C, 1M, and 1BK includes a photosensitive drum as an image carrier, a charging device including a charging roller, a developing device including a developing roller, and a cleaning device including a cleaning blade. A bearing 17 rotatably supports a supporting shaft 16 for the photosensitive drum. A carrier supporting member 15 supports each photosensitive drum, and includes the supporting shaft 16 and the bearing 17. A positioning unit 70 that is configured to open and close is attachable to and detachable from the image forming apparatus 7, and positions each of the process cartridges 1Y, 1C, 1M, and 1BK via a corresponding one of the carrier supporting members 15.

As indicated by an arrow D in FIG. 8, when the positioning unit 70 is set to the image forming apparatus 7, positioning holes 35*a* and 35*b* on the left and right sides of a positioning holding member 32A are fitted with positioning pins 36*a* and 36*b* on the left and right sides of the image forming apparatus 7 and are arranged at positions opposite to the positioning holes 35*a* and 35*b*.

The positioning unit 70 includes the positioning holding member 32A having sets of planes 78 and 79 as holding portions, four pressing members 44A in correspondence with the carrier supporting members 15 for the process cartridges 1Y, 1C, 1M, and 1BK each of which is configured to move between a non-pressing position and a pressing position, springs 71 that serve as biasing units each of which biases the corresponding one of the pressing members 44A in such a direction that the pressing member 44A moves toward the pressing position, and a sliding member 41A that movably supports the pressing members 44A and serves as a movable member being slidably and movably supported by the positioning holding member 32A between a first position shown in FIG. 10 that corresponds to the non-pressing position and a second position shown in FIG. 11 that corresponds to the pressing position. Each set of the of planes 78 and 79 is provided in four openings as attachment holes 77 in which the carrier supporting members 15 are respectively held by the weight of the process cartridges 1Y, 1C, 1M, and 1BK when the positioning unit 70 is closed on the image forming apparatus 7 after being swung in the direction indicated by the arrow D. The non-pressing position shown in FIG. 10 is a position at which each pressing member 44A is not in contact with the corresponding one of the carrier supporting members 15 placed on the planes 78 and 79 of the attachment hole 77. The pressing position shown in FIG. 11 is a position at which each pressing member 44A is pressing and positioning the corresponding one of the carrier supporting members 15 that are placed on the planes 78 and 79 of the attachment hole 77.

As shown in FIGS. 8 to 11, when any of the photosensitive drums or the like needs to be replaced, i.e., when any of the process cartridges 1Y, 1C, 1M, and 1BK or the like needs to be replaced, the sliding member 41A that is slidably supported by the positioning holding member 32A is slid to the first position as shown in FIG. 10, toward the left side of the drawing. As a result, the pressing members 44A are placed in the non-pressing positions at which the pressing members 44A are positioned away from the bearings 17 of the photosensitive drums. Subsequently, the positioning unit 70 is swung in the direction indicated by an arrow C in FIG. 8, centering on hinge pins 34, so that the positioning unit 70 is opened from the image forming apparatus 7 and is placed in an open position.

When the replacement of the photosensitive drum or the like is finished, the positioning unit 70 is swung in the direction indicated by the arrow D in FIG. 8, centering on the hinge pins 34, so that the positioning unit 70 is attached to and set to the image forming apparatus 7. Subsequently, the sliding member 41A is slid as shown in FIG. 11, toward the right side of the drawing, to be in a set state in the second position. As a result, the pressing members 44A are placed in the pressing positions at which each of the pressing members 44A is in contact with and pressing the corresponding one of the bearings 17 of the photosensitive drums. Thus, the bearings of the photosensitive drums are positioned and held in their respective predetermined positions.

As shown in FIG. 17, on the sliding member 41A is a pin 93 used for moving the sliding member 41A. The positioning holding member 32A has a cover 90. Provided on the cover 90 is an operation lever 94 that is made of a resin and has a guiding groove 94*b*, which is configured to be fitted with the pin 93 on the sliding member 41A.

FIG. 30 is a view of the operation lever 94 from the back. The sliding movement of the sliding member 41A caused by an operation of the operation lever 94 will be explained with reference to FIG. 30.

The operation lever 94 has the guiding groove 94*b*, a rotation shaft 94*a* that is a basal portion of the operation lever 94, and a handle unit 94*c* that is a portion actually used in manual operations. When the operation lever 94 is turned by a predetermined angle in the direction indicated by an arrow K, centering on the rotation shaft 94*a*, i.e., when the operation lever 94 is swung, the pin 93 on the sliding member 41A is moved in the guiding groove 94*b* in a substantially horizontal direction. Thus, the sliding member 41A is slid in the same direction.

However, a first problem arises that a user or an operator (hereinafter, "operator") who is not familiar with the operation of the apparatus is not able to identify a position at which it is possible to improve the operability and the workability of the operation lever 94.

In addition, especially for a full-color image forming apparatus or the like, the positioning holding member 32A tends to be manufactured so that the length thereof extends in the left-and-right direction (the horizontal direction). In such a case, to improve the level of precision in positioning of the positioning holding member 32A with respect to the image forming apparatus 7, it is necessary to arrange the positioning holes 35*a* and 35*b* and the positioning pins 36*a* and 36*b* so that they have as large a distance as possible therebetween in the left-and-right direction (in the horizontal direction) of the positioning holding member 32A. In consideration of reduction in the weight and the cost of the positioning unit 70, it is generally common to manufacture the positioning holding member 32A with sheet metal or the like and the cover 90 with a resin or the like. Thus, the positioning unit 70 and the cover 90 tend to slightly warp on either end thereof in the left-and-right direction (in the horizontal direction). As a result, the positioning holes 35*a* and 35*b* and the positioning pins 36*a* and 36*b* do not fit with one another all the way. Thus, a second problem arises that it is difficult to activate a locking device (not shown).

Further, when the operation lever 94 is swung in the direction of the arrow K so that the sliding member 41A makes the sliding movement to one of the first position and the second position, an operator who is not familiar with the operation of the apparatus may apply a force in the direction indicated by an arrow E directing from the cover 90 toward the operator. Thus, a third problem arises that the applied force may damage or break the operation lever 94 that is made of, for example, a resin.

Furthermore, when the operation lever 94 is operated incorrectly by an operator who is not familiar with the operation of the apparatus or an unspecified person, a fourth problem arises that the positioning of the process cartridges (the image carrier units) 1Y, 1C, 1M, and 1BK by the positioning unit 70 is cancelled suddenly or unexpectedly or becomes insufficient.

SUMMARY OF THE INVENTION

It is an object of the present invention to at least partially solve the problems in the conventional technology.

According to an aspect of the present invention, an image forming apparatus includes an image carrier unit that includes an image carrier and a carrier supporting member that supports the image carrier, a positioning unit that is configured to open and close and to be attached to and detached from the image forming apparatus and positions the image carrier unit via the carrier supporting member, a positioning member that positions the positioning unit when the positioning unit is closed, and a positioned member that is located on the positioning unit and engages with the positioning member. The positioning unit includes a holding member that includes an opening having a holding portion to hold the carrier supporting member when the positioning unit is closed and positioned in a predetermined position, a pressing unit that presses and positions the carrier supporting member at the holding portion, a cover that opposes the holding member via the pressing unit, and an operating unit that is used for operating the pressing unit and located on the cover at a position corresponding to near middle of the holding member in a longitudinal direction. An image formed on the image carrier is transferred onto a recording medium directly or indirectly.

According to another aspect of the present invention, an image forming apparatus includes an image carrier unit that includes an image carrier and a carrier supporting member that supports the image carrier, a positioning unit that is configured to open and close and to be attached to and detached from the image forming apparatus and positions the image carrier unit via the carrier supporting member. The positioning unit includes a holding member that includes an opening having a holding portion to hold the carrier supporting member when the positioning unit is closed and positioned in a predetermined position, a pressing unit that presses and positions the carrier supporting member at the holding portion, a cover that opposes the holding member via the pressing unit, and an operating unit that is used for operating the pressing unit and configured to be swingable about a rotation axis. An image formed on the image carrier is transferred onto a recording medium directly or indirectly, and the cover includes a regulating member that regulates movement of the operating unit in a direction along the rotation axis.

According to still another aspect of the present invention, an image forming apparatus includes image carrier means including an image carrier and a carrier supporting member for supporting the image carrier, first positioning means for positioning the image carrier unit via the carrier supporting member, the first positioning means being configured to open and close and to be attached to and detached from the image forming apparatus, second positioning means for positioning the first positioning unit when the first positioning unit is closed, and positioned means that is located on the first positioning means and engages with the second positioning means. The first positioning means includes holding means including an opening having a holding portion for holding the carrier supporting member when the first positioning means is closed and positioned in a predetermined position, pressing means for pressing and positioning the carrier supporting member at the holding portion, cover means that opposes the holding means via the pressing means, and operating means for operating the pressing means, the operating means being located on the cover at a position corresponding to near middle of the holding means in a longitudinal direction. An image formed on the image carrier is transferred onto a recording medium directly or indirectly.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
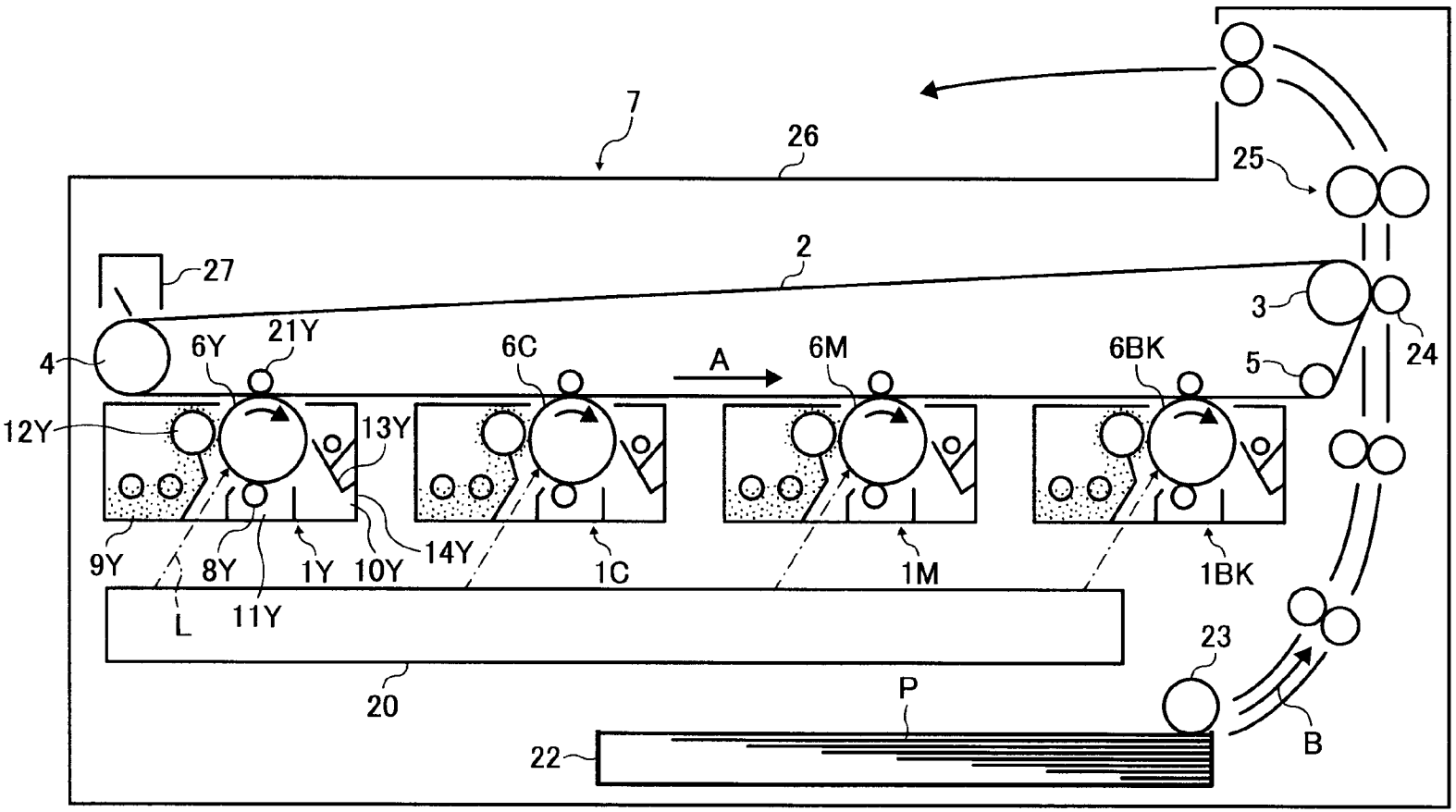
FIG. 1 is a schematic cross section of an image forming apparatus according to an embodiment of the present invention is applied.

Exemplary embodiments of the present invention will be explained with reference to the accompanying drawings. Throughout the drawings as well as the description below, corresponding parts will be referred to by using like reference characters, as long as they are identifiable and, the same explanation will not be repeated as much as possible. To simplify the drawings and the explanation, some constituent elements may be omitted from the drawings without notice, if they do not need to be particularly explained with the drawings.

The overall configuration and the operation of an image forming apparatus according to an embodiment of the present invention will be explained with reference to FIG. 1.

The image forming apparatus is configured as a tandem image forming apparatus that forms full-color images. The image forming apparatus includes first to fourth process cartridges 1Y, 1C, 1M, and 1BK that are mounted on and arranged in an image forming apparatus 7 and an intermediate transfer belt 2 that is arranged to oppose these process cartridges 1Y, 1C, 1M, and 1BK. The intermediate transfer belt 2 is an endless belt and is wound around a plurality of rollers 3, 4, and 5 including one or more driving rollers and one or more driven rollers. The process cartridges 1Y, 1C, 1M, and 1BK respectively include photosensitive members 6Y, 6C, 6M, and 6BK each of which is in the form of a drum (hereinafter, "photosensitive drums") and serves as an image carrier. Toner images in mutually different colors are formed on the photosensitive drums respectively, and the toner images are sequentially transferred onto the intermediate transfer belt 2.

The process cartridges 1Y, 1C, 1M, and 1BK are configured to be attachable to and detachable from the image forming apparatus 7 in the longitudinal direction of the rotation shaft (not shown) of the photosensitive drums 6Y, 6C, 6M, and 6BK, the direction being considered as substantially the open-and-close direction of a positioning unit, which is described later.

The configurations of the first to fourth process cartridges 1Y, 1C, 1M, and 1BK and the configuration for transferring the toner images formed on the photosensitive drums 6Y, 6C, 6M, and 6BK onto the intermediate transfer belt 2 are all substantially the same with one another, except that the colors of the toner images are different. Thus, the configuration of the first process cartridge 1Y and the configuration for transferring a toner image on the photosensitive drum 6Y onto the intermediate transfer belt 2 will be explained as an example, and the explanation for the rest will be omitted. To simplify the drawings, as for the same constituent elements shown in FIG. 2 and the drawings thereafter, the alphabet letters expressing the colors are only appended to the reference numerals referring to the process cartridges, the photosensitive drums, and the cartridge cases. The alphabet letters expressing the colors are omitted from the reference numerals referring to the other constituent elements.

The first process cartridge 1Y includes a charging device 11Y including a charging roller 8Y around the photosensitive drum 6Y, a developing device 9Y including a developing roller 12Y, and a cleaning device 10Y including a cleaning blade 13Y. A cartridge case 14Y serves as a unit case in common among charging devices 11Y, 9Y, and 10Y.

Figure 2:
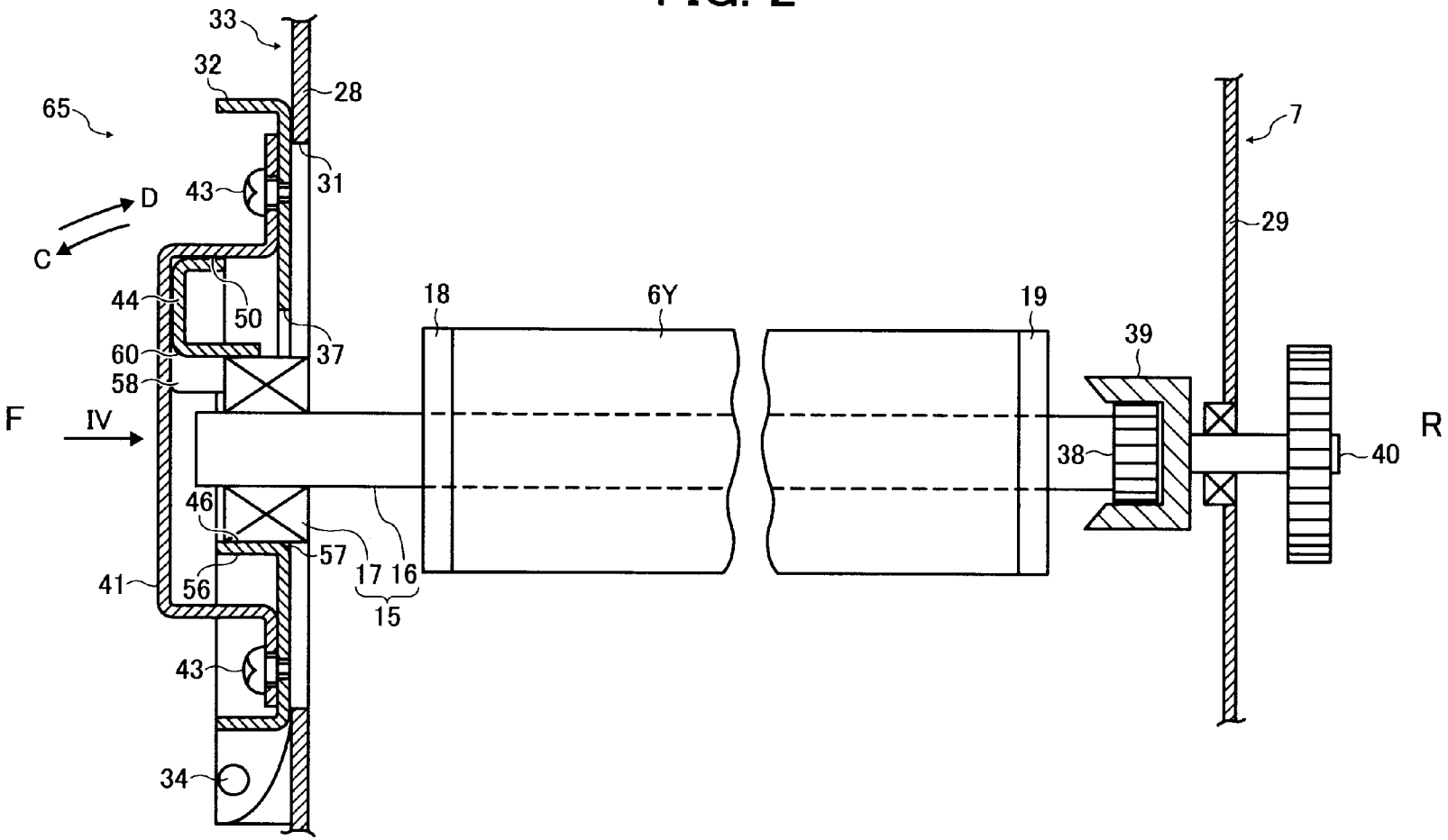
FIG. 2 is a schematic cross section of a photosensitive drum and a configuration to support the photosensitive drum according to a first comparative example.
Figure 3:
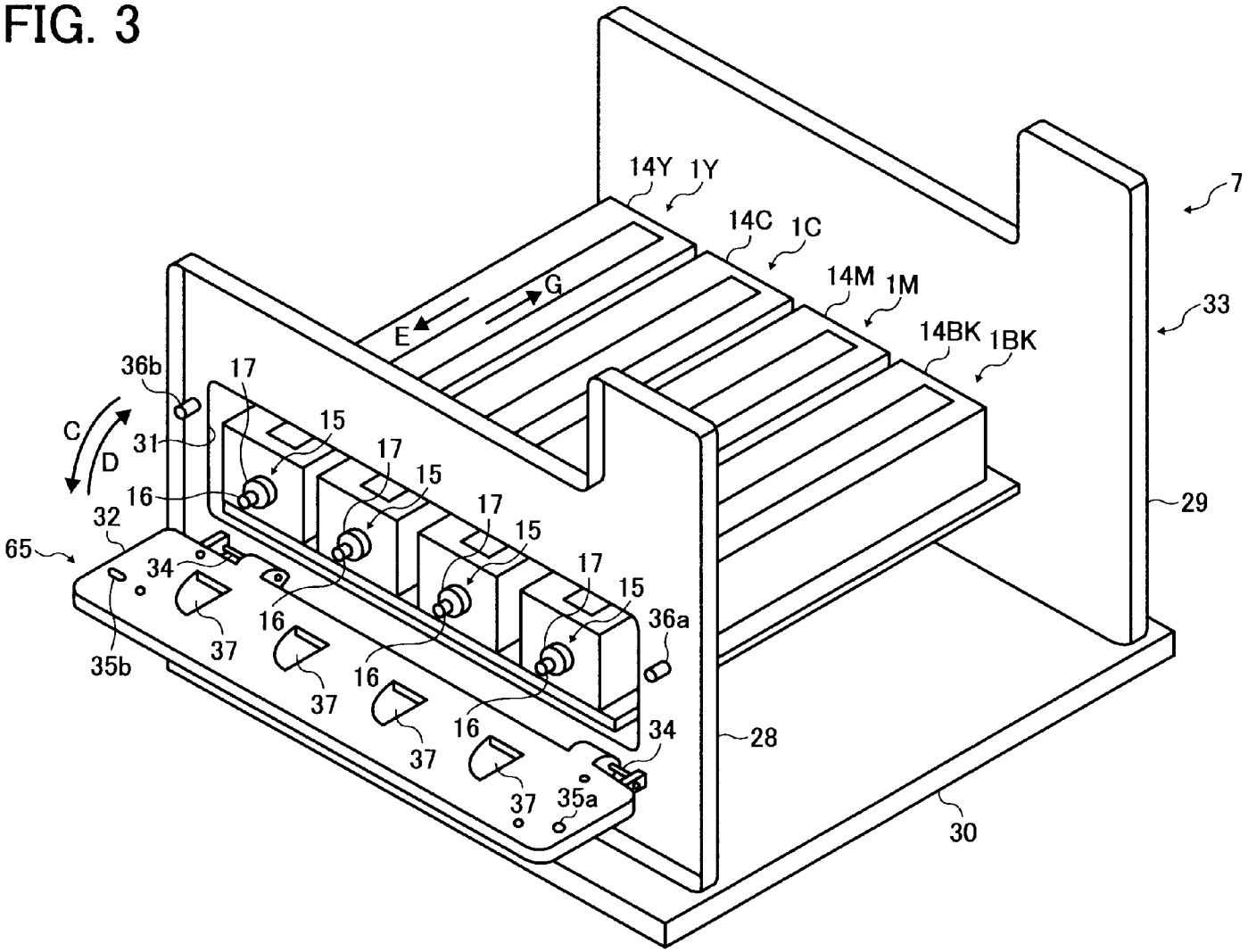
FIG. 3 is a schematic perspective view of a frame of an image forming apparatus, process cartridges, and a positioning holding member according to the first comparative example.

FIG. 2 is a partial cross section of the photosensitive drum 6Y in the process cartridge 1Y and the carrier supporting member 15 that supports the photosensitive drum 6Y. The other constituent elements of the process cartridge 1Y are omitted from FIG. 2. As shown in FIG. 3 also, the carrier supporting member 15 includes the supporting shaft 16 as a rotation shaft and a bearing that is, for example, a ball bearing and is attached to the supporting shaft 16. The photosensitive drum 6Y is fixed to and supported by the supporting shaft 16 via flanges 18 and 19 that are fixed on either end of the photosensitive drum 6Y. The supporting shaft 16 is rotatably assembled into the cartridge case 14Y shown in FIG. 1 via a bearing (not shown).

When an image forming operation is started, the photosensitive drum 6Y is driven and rotated in the clockwise direction in FIG. 1. The intermediate transfer belt 2 is driven and rotated in the direction indicated by an arrow A. In this situation, the charging roller 8Y in the charging device 11Y rotates while being in contact with the surface of the photosensitive drum 6Y. Due to the action of the charging roller 8Y, the photosensitive drum 6Y is charged with a predetermined polarity. After being charged, the photosensitive drum 6 is irradiated with a laser beam L that has been optically modulated and emitted from an exposing device 20 shown in FIG. 1, which is provided separately from the process cartridge 1Y. As a result, an electrostatic latent image is formed on the photosensitive drum 6Y.

The developing roller 12Y in the developing device 9Y is driven and rotated in the counterclockwise direction in FIG. 1. A dry developer is carried and conveyed on the developing roller 12Y. Then, the yellow toner contained in the developer electrostatically moves and adheres to the electrostatic latent image formed on the photosensitive drum 6Y so that the electrostatic latent image is converted into a visible image as a yellow toner image. A primary transfer roller 21Y is provided on the opposite side of the intermediate transfer belt 2 from the process cartridge 1Y. Due to the action of the primary transfer roller 21Y, the toner image formed on the photosensitive drum 6Y is transferred onto the intermediate transfer belt 2. The residual toner that is remaining after the toner image has been transferred and has adhered to the photosensitive drum 6Y is scraped and removed from the surface of the photosensitive drum 6Y by the cleaning blade 13Y in the cleaning device 10Y.

In the same manner as described above, a cyan toner image, a magenta toner image, and a black toner image are respectively formed on the photosensitive drums 6C, 6M, and 6BK that are respectively included in the second to fourth process cartridges 1C, 1M, and 1BK shown in FIG. 1. These toner images are sequentially transferred, one on top of another, onto the intermediate transfer belt 2 on which the yellow toner image has already been transferred.

Also, as shown in FIG. 1, at the bottom of the image forming apparatus 7 is a paper feeding cassette 22 that contains sheets of transfer paper P as an example of sheet-like recording media. A sheet of transfer paper P positioned at the top is forwarded in the direction indicated by an arrow B due to the rotation of the paper feeding roller 23. The forwarded sheet of paper P is fed to a position between the intermediate transfer belt 2 and a secondary transfer roller 24 that serves as a secondary transfer unit and is arranged to oppose the intermediate transfer belt 2. In this situation, due to the action of the secondary transfer roller 24, the toner image formed on the intermediate transfer belt 2 is transferred onto the sheet of paper P. The recording medium on which the toner image has been transferred is further conveyed upward and passes through a fixing unit 25. At this time, the toner image on the recording medium is fixed by heat and pressure. The recording medium that has passed through the fixing unit 25 is ejected into a paper ejecting unit 26 of the image forming apparatus 7. The residual toner that is remaining after the toner image has been transferred and has adhered to the intermediate transfer belt 2 is removed by a cleaning unit 27 for cleaning the intermediate transfer belt 2.

FIRST COMPARISON EXAMPLE

Next, the configuration and operation for positioning required when the process cartridges 1Y, 1C, 1M, and 1BK are mounted on the image forming apparatus 7 will be explained. As explained later, the embodiments of the present invention are presented to make improvements on the configuration (hereinafter, "first comparative example") shown in FIGS. 2 to 7 and the configuration (hereinafter, "second comparative example") shown in FIGS. 8 to 18 to achieve the objects of the present invention. Thus, the comparative examples will be explained in detail.

The reference character F in FIG. 2 denotes the front side of the image forming apparatus. The reference character R denotes the back side, i.e., the rear side, of the image forming apparatus. As described later, the process cartridge 1Y and the other process cartridges 1C, 1M, and 1BK are detachably attached to the image forming apparatus 7 in a front-and-back direction, in other words, in the longitudinal direction of the supporting shaft 16. A frame 33 that structures the image forming apparatus 7 includes a front board 28 on the front side thereof as well as, as shown in FIG. 3, a rear board 29 on the back side thereof and a bottom board (FIG. 3) to which these boards 28 and 29 are fixed.

Figure 4:
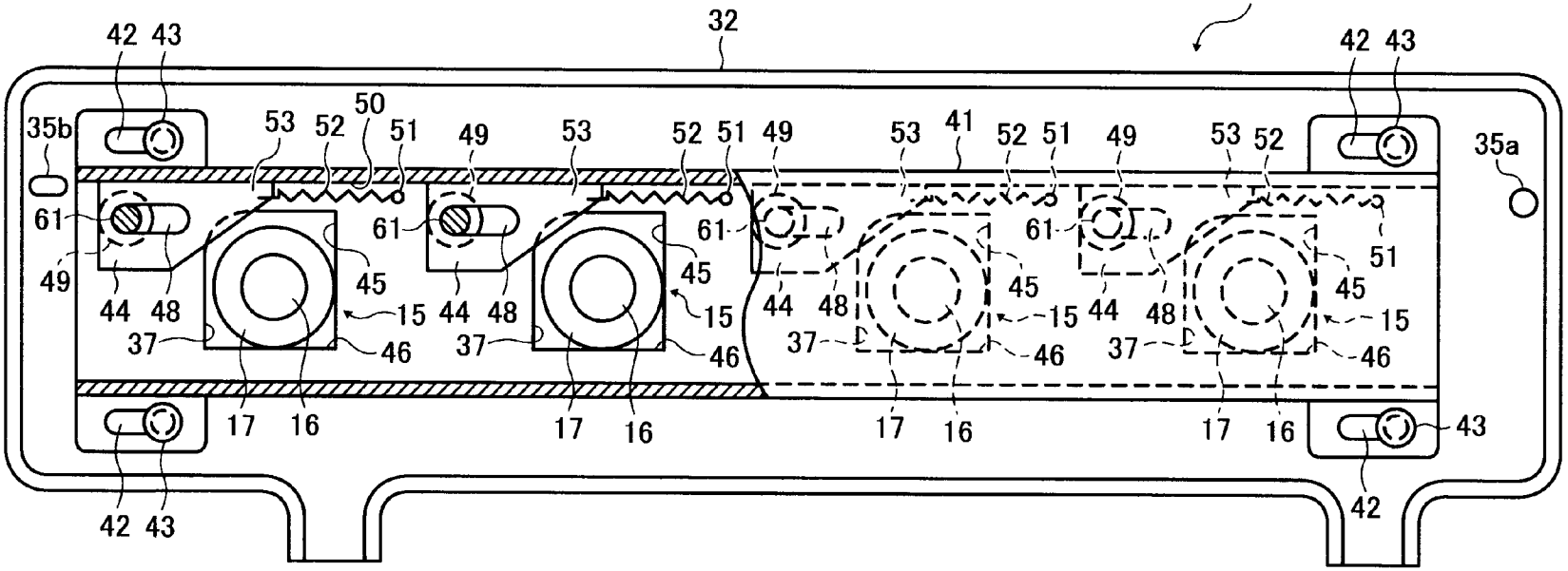
FIG. 4 is a front view of the positioning holding member that is in a closed position and a sliding member placed in a first position according to the first comparative example.

An opening 31 formed in the front board 28 on the image forming apparatus 7 side is normally covered by a positioning unit 65, as shown in FIGS. 2 to 4, the positioning unit 65 being configured to open and close and to attach, detach, and position the process cartridges 1Y, 1C, 1N, and 1BK via the carrier supporting members 15. As shown in FIGS. 2 to 7, the positioning unit 65 includes a positioning holding member 32 that has sets of two planes 45 and 46 as holding portions, and pressing units (described later) that press and position the carrier supporting members 15 each being held on the two planes 45 and 46. Each set of two planes 45 and 46 is provided in openings as attachment holes 37 in which the carrier supporting members 15 are respectively held when the positioning unit 65 is closed on the opening 31 in the front board 28

An exterior cover (not shown) and a front cover (not shown) supported by the exterior cover are arranged around the frame 33 and the positioning holding member 32.

As shown in FIGS. 2 and 3, the positioning holding member 32 is adhered pivotally to the front board 28 via a pair of the hinge pins 34 in such a manner that the positioning holding member 32 is able to turn within a range of a predetermined angle in the directions indicated by the arrows C and D, in other words, in such a manner that the positioning holding member 32 is able to swing and open and close. Normally, the positioning holding member 32 is in a closed position shown in FIG. 2. When the positioning holding member 32 is in an open position, the positioning hole 35*a* formed in the positioning holding member 32 is fitted with the positioning pin 36*a* provided so as to project from the front board 28. Also, another positioning hole 35*b* formed in the positioning holding member 32 is fitted with the positioning pin 36*b* that is provided so as to project from the front board 28. As a result, the positioning holding member 32 is positioned with respect to the frame 33 of the image forming apparatus 7. The position of the positioning holding member 32 in this situation is a predetermined attachment position obtained as a result of positioning of the positioning holding member 32 with respect to the frame 33. As explained above, the positioning holding member 32 is positioned in the predetermined attached position with respect to the frame 33 of the image forming apparatus 7 in such a manner that the positioning holding member 32 is attached while being able to open and close.

Figure 8:
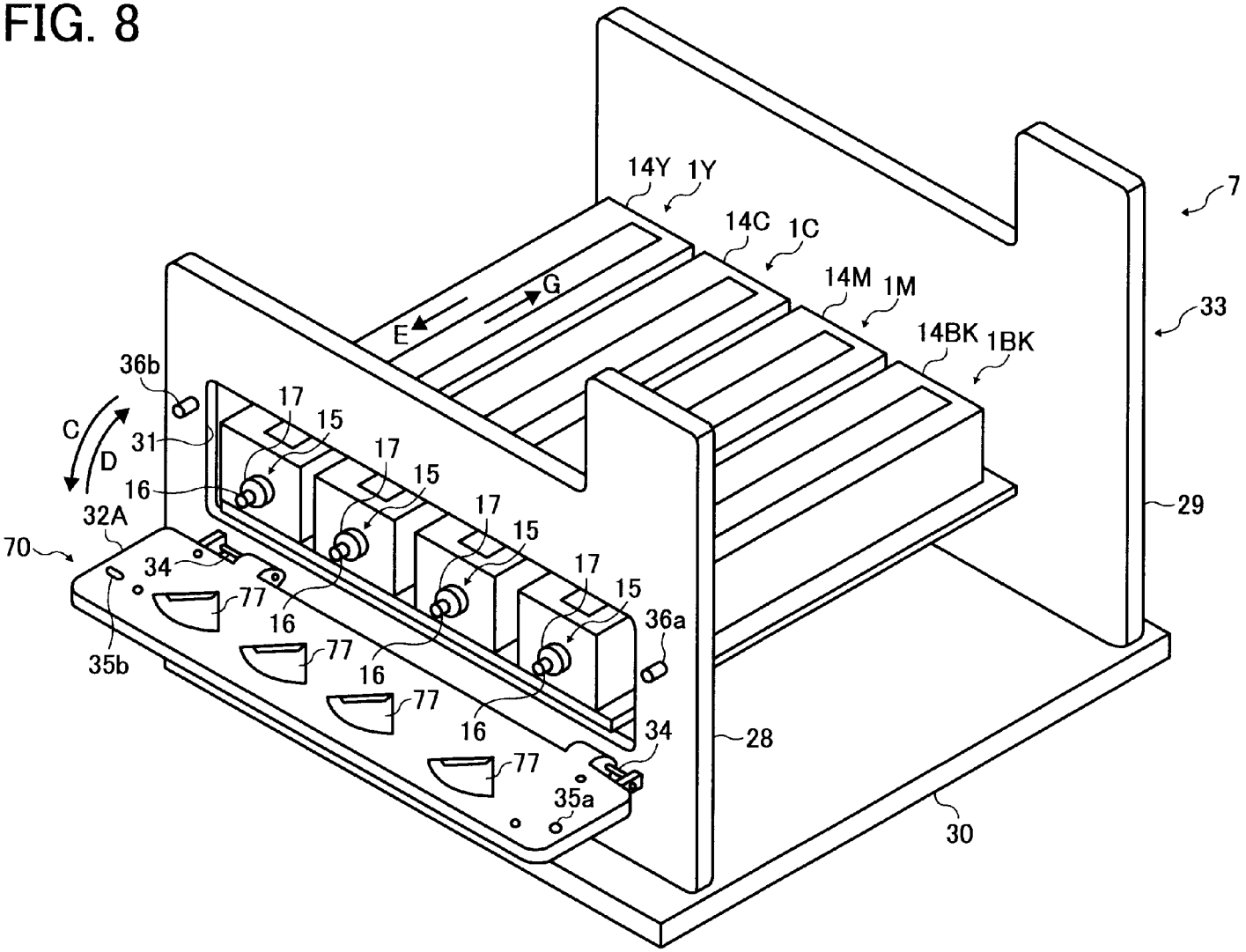
FIG. 8 is a schematic perspective view of a frame of an image forming apparatus, process cartridges, and a positioning holding member according to a second comparative example.

Also, when the positioning holding member 32 (the positioning unit 65) is in the predetermined attachment position that is obtained as a result of the positioning of the positioning holding member 32 with respect to the frame 33, the positioning holding member 32 is fixed because locking tabs (not shown) in a locking mechanism/device on the positioning unit 65 side engage with grooves (not shown) formed on the positioning pins 36*a* and 36*b*. This arrangement is the same for the positioning unit 70 that is shown in FIG. 8 and the like, according to a second comparative example explained later.

The positioning pins 36*a* and 36*b* have functions as a positioning member and a positioning projection that are used for positioning the positioning holding member 32 or the positioning holding member 32A shown in FIG. 8 (explained later) with respect to the image forming apparatus 7, when the positioning unit 65 or the positioning unit 70 shown in FIG. 8 (explained later) is closed on the image forming apparatus 7 and is positioned in the predetermined attachment position (the closed position). The positioning holes 35*a* and 35*b* have functions as a positioned member and a positioning depression that are configured to fit with the positioning pins 36*a* and 36*b*.

The positioning holes 35*a* and 35*b* have the same shape and the same size, although they look different in the drawings so that the positions at which they are provided on the left side and on the right side can be distinguished. Likewise, the positioning pins 36*a* and 36*b* have the same shape and the same size and are made of, for example, metal such as steel.

As shown in FIG. 3, the positioning holding member 32 has the attachment holes 37 in correspondence with the carrier supporting members 15. When the positioning holding member 32 is in the closed position shown in FIG. 2, i.e., in the predetermined attachment position, a portion on the front side of each of the carrier supporting members 15 (each bearing 17 in this example) is fitted into and held by a corresponding one of the attachment holes 37, and thus, the portion on the front side of each of the carrier holding members 15 is positioned with respect to the positioning holding member 32, as explained later. As explained above, the positioning holding member 32 has the attachment holes 37 into which and by which the carrier supporting members 15 are fitted and held while the positioning holding member 32 is attached to the attachment position.

On the other hand, as shown in FIG. 2, a carrier gear 38 is fixed to an end of the supporting shaft 16 on the back side, the supporting shaft 16 supporting the photosensitive drum 6Y in the process cartridge 1Y. A shaft 40 for a cup-shaped gear 39 is rotatably supported by the rear board 29, the cup-shaped gear 39 being configured to be attachable to and detachable from the carrier gear 38. In the state shown in the drawing, the carrier gear 38 is engaging with the cup-shaped gear 39. As a result, the end of the supporting shaft 16 on the back side is positioned with respect to the rear board 29 in terms of the longitudinal direction of the supporting shaft 16. Rotation preventing pins (now shown) are provided so as to project on the front side and on the back side of the cartridge case 14Y.

The rotation preventing pins are fitted into holes (not shown) in the positioning holding member 32 and the rear board 29. Consequently, the process cartridge 1Y is prevented from rotating around the supporting shaft 16.

The shaft 40 is driven and rotated by a motor (not shown). The rotation of the shaft 40 is transferred to the supporting shaft 16 via the gears 39 and 38. As a result, the photosensitive drum 6Y is driven and rotated, as described above. In this situation, the portion on the front side of the supporting shaft 16 is held in the attachment hole 37 in the positioning holding member 32, via the bearing 17. Thus, the supporting shaft 16 is able to rotate without any hindrance.

An end on the back side of each of the supporting shafts 16 for the other process cartridges 1C, 1M, and 1BK is also positioned with respect to the rear board 29 in the same manner as described above. Also, the supporting shafts 16 and the photosensitive drums 6C, 6M, and 6BK are driven and rotated in the same manner as descried above.

When the front door (not shown) is opened, and the positioning holding member 32 is turned to the open position shown in FIG. 3 while the operation of the motor is stopped, the opening 31 becomes open. In this situation, when the process cartridge 1Y is pulled toward the front of the apparatus in the direction indicated by the arrow E, the process cartridge 1Y is pulled out toward the front of the apparatus while being guided on a guide rail in an attaching/detaching unit (not shown). Conversely, when the process cartridge 1Y is pushed toward the back of the apparatus in the direction indicated by an arrow G, the process cartridge 1Y is pushed in toward the back of the apparatus while being guided on the guide rail. As a result, as shown in FIG. 2, the carrier gear 38 engages with the cup-shaped gear 39, and the end of the supporting shaft 16 on the back side is positioned with respect to the frame 33. Subsequently, the positioning holding member 32 is swung to the closed position shown in FIG. 2 and is positioned with respect to the front board 28. In this situation, it is possible to position the portion of the supporting shaft 16 on the front side with respect to the frame 33, as explained later. Subsequently, the front door is closed, and it becomes possible to start an image forming operation. It is possible to attach and detach the other process cartridges 1C, 1M, and 1BK to and from the image forming apparatus 7, in the same manner.

Next, a specific configuration for positioning the portion of each of the carrier supporting members 15 on the front side with respect to the frame 33 of the image forming apparatus 7 will be explained.

As explained above, FIG. 4 is a drawing for explaining a situation in which the process cartridges 1Y, 1C, 1M, and 1BK have been pushed to the back side of the image forming apparatus 7, the positioning holding member 32 is turned to the closed position, the positioning holes 35*a* and 35*b* in the positioning holding member 32 are fitted with the positioning pins 36*a* and 36*b* that are provided so as to project from the front board 28, and the positioning holding member 32 is positioned in the predetermined attachment position. FIG. 4 is a view viewed in the direction of an arrow IV in FIG. 2. As understood from FIGS. 2, 4, and 6, a sliding member 41 is provided on the positioning holding member 32.

The sliding member 41 has a plurality of oblong holes 42 that are oblong in the horizontal direction. Shoulder screws 43 are inserted into the oblong holes 42 respectively, in such a manner that the shoulder screws 43 are slidable relatively. The shoulder screws 43 are screwed into the positioning holding member 32. As a result, the sliding member 41 is supported by the positioning holding member 32 in such a manner that the sliding member 41 is slidable and movable in a horizontal direction between a first position shown in FIG. 4 and a second position shown in FIG. 5.

When the positioning holding member 32 is swung from the open position shown in FIG. 3 to the closed position shown in FIG. 4, the bearings 17 are fitted into the attachment holes 37 in the positioning holding member 32. In this situation, as understood from FIG. 4, the size of each of the attachment holes 37 is arranged to be larger than the cross section area of each of the supporting shafts 16 and each of the bearings 17 that are fitted with the supporting shafts 16. Thus, the bearings 17 are fitted into the attachment holes 37 respectively with a lot of play. Accordingly, the bearings 17 are easily fitted into the attachment holes 37, respectively. As shown in FIG. 4, each of the attachment holes 37 is divided into sections by two planes, namely, the vertical plane 45 and the horizontal plane 46 that serve as the holding portions by which the corresponding one of the bearings 17 is held and by another curved plane 47. The vertical plane 45 and the horizontal plane 46 are substantially orthogonal to each other.

As shown in FIGS. 2, and 4 to 6, pressing members 44 are provided in correspondence with the bearings 17. Each of the pressing members 44 has a wedge-shaped part 53 that is in the shape of a wedge formed to be pointed on one end, as shown in FIG. 7. Further, each of the pressing members 44 has an oblong hole 48 that extends substantially horizontally. A stopper 49 that is structured by the shoulder screw screwed into the sliding member 41 is fitted into each oblong hole 48 in such a manner that the stopper 49 is slidable relatively. As a result of this arrangement, each of the pressing members 44 is able to slide and move in the horizontal direction, with predetermined strokes, with respect to the sliding member 41.

The lower lateral face of a flange portion at the top of the sliding member 41 functions as a guiding plane 50 that guides the pressing members 44 when the pressing members 44 move in the horizontal direction. Thus, the sliding member 41 has the guiding plane 50 to be used for the pressing members 44.

As shown in FIG. 4, two ends of each of tension springs 52 serving as biasing units are seized by a corresponding one of the pressing members 44 and a corresponding one of capturing pins 51 provided so as to project from the sliding member 41, respectively. As a result, the pressing members 44 are biased toward the right side direction in FIG. 4. However, while the sliding member 41 is placed in the first position shown in FIG. 4, an end 61 of each of the oblong holes 48 abuts against the corresponding one of the stoppers 49, and the pressing members 44 are stopped at the positions shown in FIG. 4. In this situation, the pressing members 44 are not in contact with the bearings 17 for the carrier supporting members 15.

As explained above, the pressing members 44 are movably supported by the sliding member 41 while being biased by the springs 52. While the sliding member 41 is in the first position, the pressing members 44 that are biased by the springs 52 are regulated by the stoppers 49 on the sliding member 41 and are prevented from being in contact with the carrier supporting members 15. Thus, when an operator has manually swung the positioning holding member 32 from the open position shown in FIG. 2 to the closed position shown in FIG. 4, it is possible to fit the bearings 17 into the attachment holes 37, respectively, without having the bearings 17 interfering with the pressing members 44.

Figure 5:
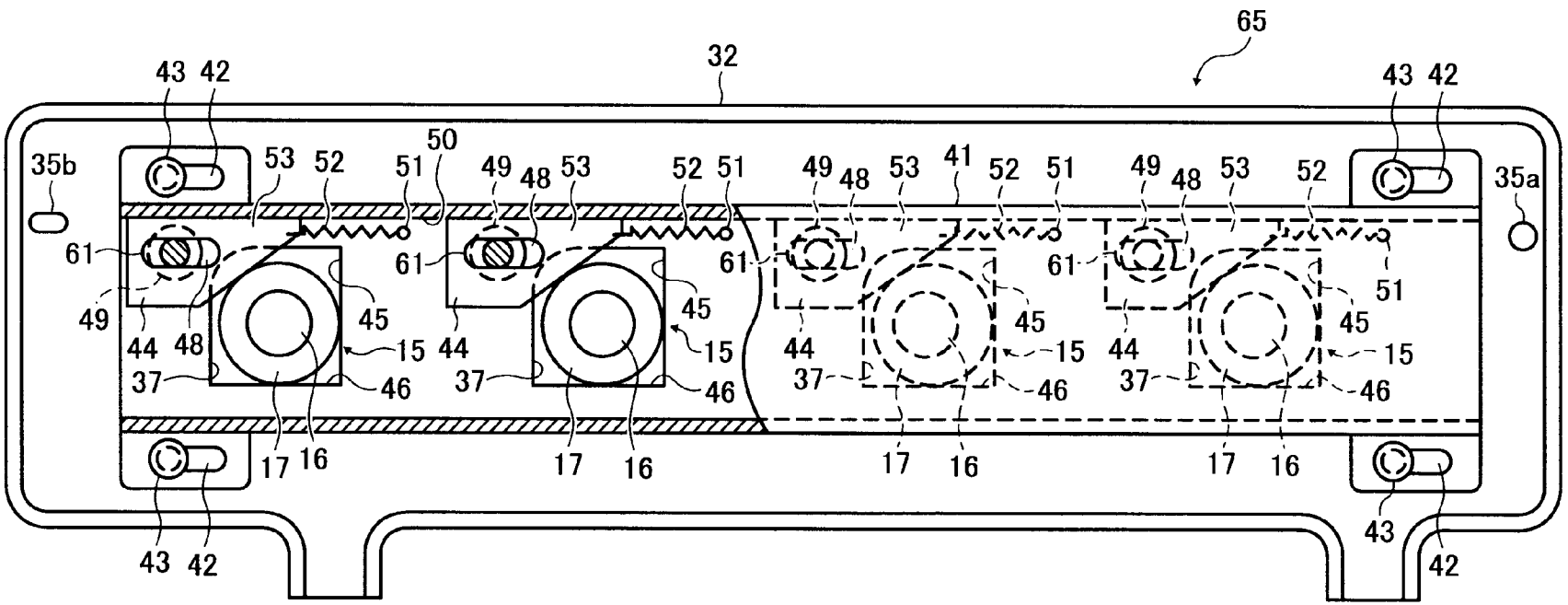
FIG. 5 is a front view of the positioning holding member that is in the closed position and the sliding member placed in a second position according to the first comparative example.

Next, when the operator manually slides the sliding member 41 shown in FIG. 4 toward the right side so that the sliding member 41 is placed in the second position shown in FIG. 5, the wedge-shaped parts 53 in the pressing members 44 are pressed into positions between the guiding plane 50 and the bearings 17 for the carrier supporting members 15. Thus, each of the bearings 17 is pressed against the two planes 45 and 46 that divide a corresponding one of the attachment holes 37 into sections. The action in this situation will be explained below in details.

When the sliding member 41 starts being moved from the first position shown in FIG. 4 to the second position shown in FIG. 5, each of the pressing members 44 that have been biased by the springs 52 and regulated by the stoppers 49 starts moving toward the right side in FIG. 4, together with the sliding member 41. Subsequently, when the sliding member 41 has reached a predetermined position located between the first position and the second position, each of the wedge-shaped parts 53 in the pressing members 44 that are biased by the springs 52 is pressed into the position between the guiding plane 50 and the corresponding one of the bearings 17 for the carrier supporting members 15 and is stopped when being pressed against and in contact with an outer circumferential surface of the bearing 17. As a result, each of the pressing members 44 intensely presses the corresponding one of the bearings 17 against the two planes 45 and 46 of a corresponding one of the attachment holes 37.

Even after each of the pressing members 44 has stopped, when the sliding member 41 is moved toward the second position, against the biasing forces of the springs 52, the end 61 of each of the oblong holes 48 in the pressing members 44 comes away from a corresponding one of the stoppers 49. Thus, the pressing members 44 are released from the regulation of the stoppers 49.

As explained above, due to the pressing forces from the wedge-shaped parts 53 in the pressing members 44 that are biased by the springs 52, each of the bearings 17 is pressed against and in contact with the two planes 45 and 46 in the corresponding one of the attachment holes 37. As a result, the carrier supporting members 15 and the portions on the front side of the photosensitive drums 6Y, 6C, 6M, and 6BK that are supported by the carrier supporting members 15 are positioned properly with respect to the positioning holding member 32. In this situation, the positioning holding member 32 is positioned properly with respect to the frame 33. Consequently, it means that the photosensitive drums 6Y, 6C, 6M, and 6BK are properly positioned with respect to the frame 33 of the image forming apparatus 7. The operator is able to position the photosensitive drums 6Y, 6C, 6M, and 6BK with respect to the image forming apparatus 7, by only attaching the positioning holding member 32 in the predetermined position with respect to the frame 33 and moving the sliding member 41. In addition, the size of each of the attachment holes 37 in the positioning holding member 32 is arranged to be much larger than the cross section area of the end of each of the carrier supporting members 15 on the front side. Thus, it is possible to easily fit the carrier supporting members 15 into the attachment holes 37, respectively.

Needless to say, the level of precision in the dimension of the positioning holding member 32 with respect to the frame 33, the length of the pitch between the two planes 45 and 46 in each of the attachment holes 37 of the positioning holding member 32 and the size of the constituent elements are set to be within a predetermined precision range (a predetermined tolerance) so that the photosensitive drums 6Y, 6C, 6M, and 6BK can be positioned with respect to the image forming apparatus 7.

As explained above, the pressing units include the plurality of pressing members 44 in correspondence with the carrier supporting members 15 each of which is configured to be able to move between the non-pressing position and the pressing position. The non-pressing position indicates a position at which each pressing member 44 is not in contact with the corresponding one of the carrier supporting members 15 that are placed at the holding portions, and the pressing position indicates a position at which each pressing member 44 presses and positions the corresponding one of the carrier supporting members 15 that are placed at the holding portions (the two planes 45 and 46). The pressing units further include the tension springs 52 that serve as the biasing units that bias the pressing members in such a direction that the pressing members 44 are moved toward the pressing positions, the sliding member 41 that movably supports the pressing members 44 and is movably supported by the positioning holding member 32 in such a manner that the sliding member 41 is able to move between the first position corresponding to the non-pressing position and the second position corresponding to the pressing position, and the moving unit (not shown) that moves the sliding member 41 between the first position and the second position.

Next, the problems will be summarized in the form of a comparison with a positioning method for an image carrier unit disclosed in, for example, Japanese Patent Application Laid-open No. 2001-222207. In paragraph "0067" of the application publication, a technical feature is described as follows:

". . . the shaft 12*a* of the photosensitive drum 12 in the process cartridge 10 is positioned by the coupling 95 in the driving unit 90, the bearing 201 for the CRG receiving unit 200 in the open/close lid unit 500, the hole 111 in the operation plate, and the assisting members 115 and 116 and is therefore accurately held in the color image forming apparatus."

According to the technique disclosed in the application publication, because the level of precision in the dimension is assured for the positioning portion of the bearing 201 for the CRG receiving unit 200 that performs the positioning of shaft 12 in the width direction, the friction resistance caused when the shaft 12*a* of the photosensitive drum 12 is fitted is large. Even if the positioning in the depth direction is performed by gradually staggering the timing at which the assisting members 115 and 116 abut against the shaft 12*a* of each photosensitive drum 12, a problem still remains where it is not possible to expect the operation to be as easy as the operation according to the conventional example (the first comparative example) discussed in the present application. There is also a possibility that the positioning and the rubbing between the fitted parts may cause abrasion.

As explained above, the image forming apparatus shown in FIGS. 1 to 7 includes the pressing members 44 each of which presses the corresponding one of the carrier supporting members 15 being loosely fitted with the attachment holes 37, i.e., being fitted into the attachment holes 37, against the two planes 45 and 46 that divide the corresponding one of the attachment holes 37 into sections. Each of the pressing members 44 includes the wedge-shaped part 53 that is pressed into the position between the guiding plane 50 and the corresponding one of the carrier supporting members 15 and presses the carrier supporting member 15. In addition, while the sliding member 41 is in the first position, each of the pressing members 44 that are biased by the springs 52 is regulated by the corresponding one of the stoppers 49 on the sliding member 41 and is prevented from being in contact with the corresponding one of the carrier supporting members 15. When the sliding member 41 has left the first position for the second position, each of the pressing members 44 that are biased by the springs 52 and also regulated by the stoppers 49 moves together with the sliding member 41. When the sliding member 41 has reached the position between the first position and the second position, each of the pressing members 44 that are-biased by the springs 52 stops because the wedge-shaped part 53 in each pressing member 44 is pressed into the position between the guiding plane 50 and the corresponding one of the carrier supporting members 15. The positions of the sliding member 41, the pressing members 44, the springs 52, and the stoppers 49 are arranged so that, when the sliding member 41 further moves toward the second position, the pressing members 44 are released from the regulation of the stoppers 49.

When the sliding member 41 is placed in the second position shown in FIG. 5, the wedge-shaped part 53 in each of the pressing members 44 is pressed into the position between the guiding plane 50 and the outer circumferential surface of the corresponding one of the bearings 17. Thus, each of the carrier supporting members 15 is held in the proper position by the frictional force and the biasing force of the corresponding one of the springs 52. Thus, it is possible to keep the photosensitive drums 6Y, 6C, 6M, and 6BK positioned properly. Also, when the sliding member 41 is returned to the first position shown in FIG. 4 with a manual operation, each of the pressing members 44 comes away from the outer circumferential surface of the corresponding one of the bearings 17. Thus, it is possible to swing the positioning holding member 32 to the open position shown in FIG. 3, without any hindrance.

Further, the planes 45 and 46 in each of the attachment holes 37 against which the corresponding one of the carrier supporting members 15 is pressed are substantially orthogonal to each other. Thus, it is possible to determine the position of each of the carrier supporting members 15 while the carrier supporting members 15 are held in a stable manner.

Furthermore, as shown in FIG. 7, when the angle formed by each of the wedge-shaped parts 53 in the pressing members 44 is defined as θ, if the angle θ is too large, it requires a large force to press each wedge-shaped part 53 into the position between the guiding plane 50 and the corresponding one of the bearings 17. Thus, the level of operability is lowered. Conversely, if the angle θ is too small, the movement stroke of each pressing member 44 becomes unnecessarily large. Thus, the level of operability is, again, lowered. In view of these aspects, it is preferable to arrange the angle θ to be within a range from 5° to 45°, and especially within a range from 15° to 20°.

In addition, as shown in FIGS. 2 and 7, if the two planes 45 and 46 in each of the attachment holes 37 in the positioning holding member 32 are formed as tongues 55 and 56 that are shaped as a result of a cut-and-bend process performed during the press molding process, the basal portion of each of the tongues 55 and 56 has a curved portion 57. Thus, when the positioning holding member 32 is turned to the closed position shown in FIG. 2, the curved portions 57 slide and become in contact with the bearings 17. Consequently, it is possible to avoid a problem where the bearings 17 are damaged.

In the same fashion, if a plane of each of the pressing members 44 that is in contact with the corresponding one of the carrier supporting members 15 is formed as a tongue 58 that is shaped as a result of a cut-and-bend process performed during the press molding process, as shown in FIG. 2, the basal portion of the tongue 58 has a curved portion 60. Thus, it is possible to avoid a problem where the bearings 17 are damaged when the pressing members 44 abut against the bearings 17 for the carrier supporting members 15.

The image forming apparatus explained above includes the plurality of photosensitive drums, 6Y, 6C, 6M, and 6BK. The plurality of pressing members 44 that press the carrier supporting members 15 respectively supporting the photosensitive drums are movably supported by the sliding member 41, which is used in common among the pressing members 44. Thus, by moving the single constituent element, namely the sliding member 41, it is possible to activate all the pressing members 44 and to press each of the carrier supporting members 15 against the two planes 45 and 46 in the corresponding one of the attachment holes 37, using the pressing members 44.

In addition, in the image forming apparatus shown in the drawings, the photosensitive drums 6Y, 6C, 6M, and 6BK are fixed to and supported by the supporting shafts 16 for the carrier supporting members 15. There is an arrangement in which the photosensitive drums 6Y, 6C, 6M, and 6BK are rotated by driving and rotating the supporting shafts 16 for the carrier supporting members 15. Thus, the bearings 17 are attached to the front portions of the supporting shafts 16 for the carrier supporting members 15 so that the bearings 17 are loosely fitted into the attachment holes 37, respectively. If another arrangement is used in which the photosensitive drums are rotatably supported by the supporting shafts, and only the photosensitive drums are driven and rotated while the supporting shafts are not rotated, it is possible to fit the supporting shafts directly into the attachment holes. Thus, in this situation, the carrier supporting members do not need to have the bearings 17 that loosely fit into the attachment holes 37.

Further, in the image forming apparatus according to this example, the supporting shafts 16 are integrally assembled with the photosensitive drums 6Y, 6C, 6M, and 6BK. However, another arrangement is acceptable in which the supporting shafts are assembled with the frame of the image forming apparatus either rotatably or non-rotatably, so that the photosensitive drums are assembled with the supporting shafts in such a manner that each of the photosensitive drums can be attached and detached in the axial line direction thereof. It is possible to apply the configurations described above to such an image forming apparatus without any problem. In such a situation, also, when the supporting shafts are rotatably supported by the frame, the supporting shafts and the bearings attached to the front side portions of the supporting shafts structure the carrier supporting members. When the supporting shafts are non-rotatably assembled with the frame, it is possible to fit the supporting shafts directly into the attachment holes in the positioning holding member.

Returning to the description above, the positioning holding member 32, the sliding member 41, the pressing members 44, and the like are integrally formed together with the other elements described above, using sheet metal or the like that serves as a board member. Thus, an advantageous effect is achieved where it is possible to structure the constituent elements at an extremely low cost while a predetermined level of strength, anti-abrasion characteristics, and durability are assured.

It is possible to apply, without any problem, the configurations shown in FIGS. 1 to 7 to an image forming apparatus that includes only one photosensitive drum.

The process cartridges are not limited to the process cartridges 1Y, 1C, 1M, and 1BK. For example, the process cartridges may be made up of a combination of the photosensitive drums 6Y, 6C, 6M, and 6BK and at least one of the charging device 11Y, the developing device 9Y, and the cleaning device 10Y. Furthermore, the process cartridges do not have to be of such a type that is able to perform full-color image forming process with the four process cartridges 1Y, 1C, 1M, and 1BK. The image forming apparatus may include one or more process cartridges that include a combination of the photosensitive drums and at least one of the charging unit and the developing unit. The same applies to the second comparative example, the exemplary embodiments, and the modifications described below.

SECOND COMPARISON EXAMPLE

A second comparative example is shown in FIGS. 8 to 18. The second comparative example is different from the image forming apparatus shown in FIGS. 1 to 7 as the first comparative example in that the positioning unit 70 shown in FIGS. 11, 17, and the like is used instead of the positioning unit 65. Except for this difference, the image forming apparatus in the second comparative example is substantially the same as the image forming apparatus shown in FIGS. 1 to 7.

Figure 9:
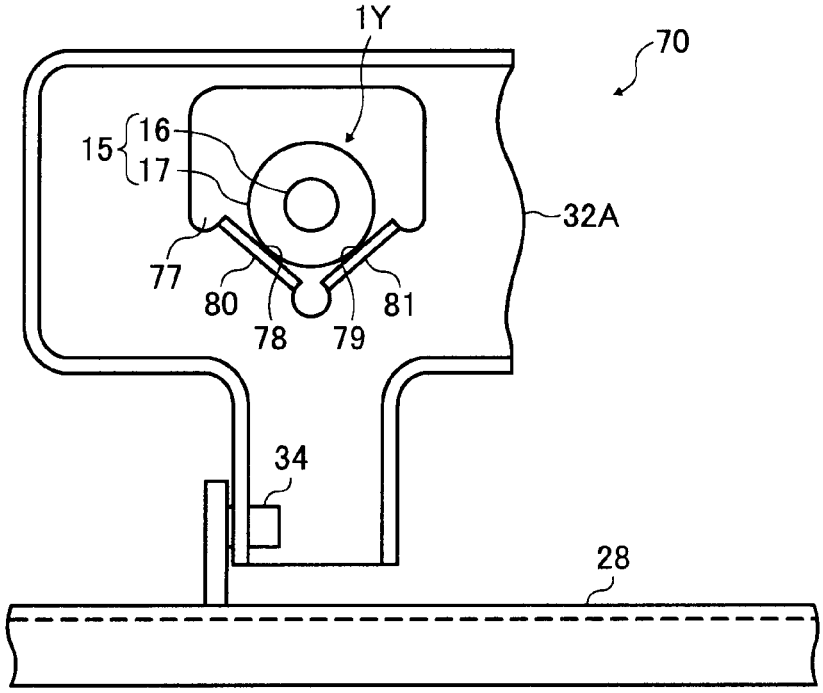
FIG. 9 is a front view of the surroundings of an attachment hole in the positioning holding member of a positioning unit according to the second comparative example.
Figure 10:
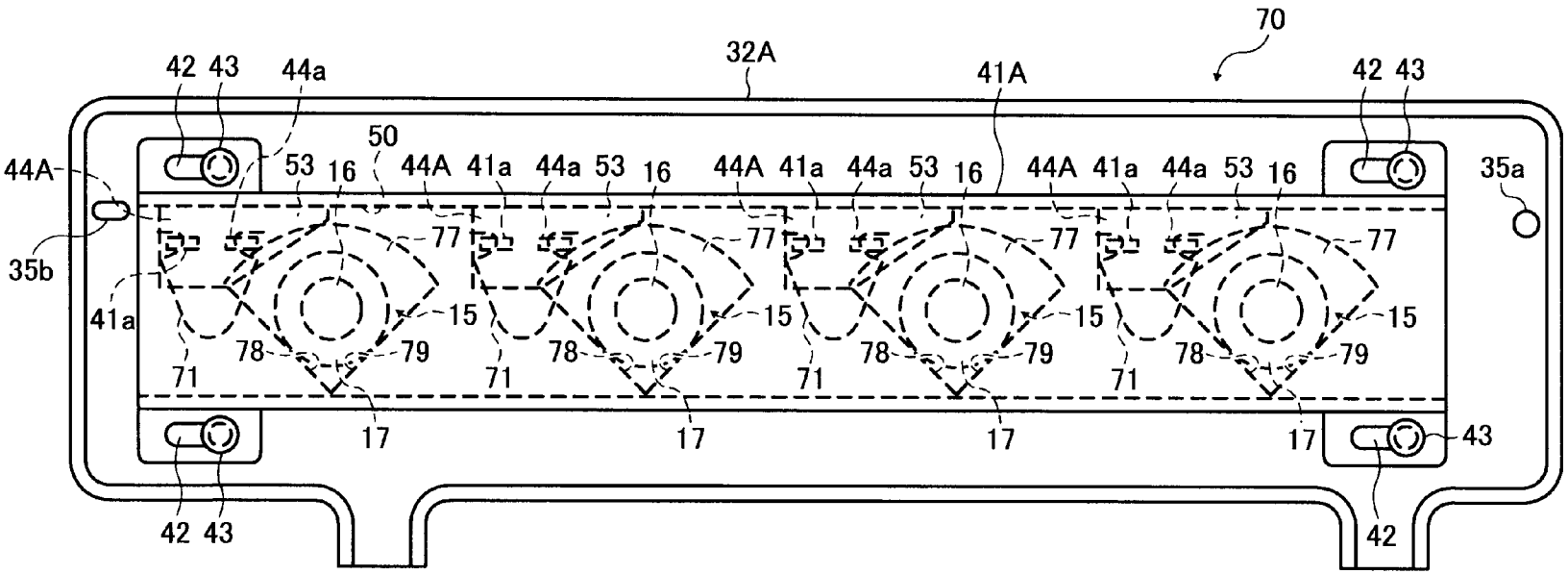
FIG. 10 is a front view of the positioning holding member that is in a closed position and a sliding member placed in a first position according to the second comparative example.
Figure 11:
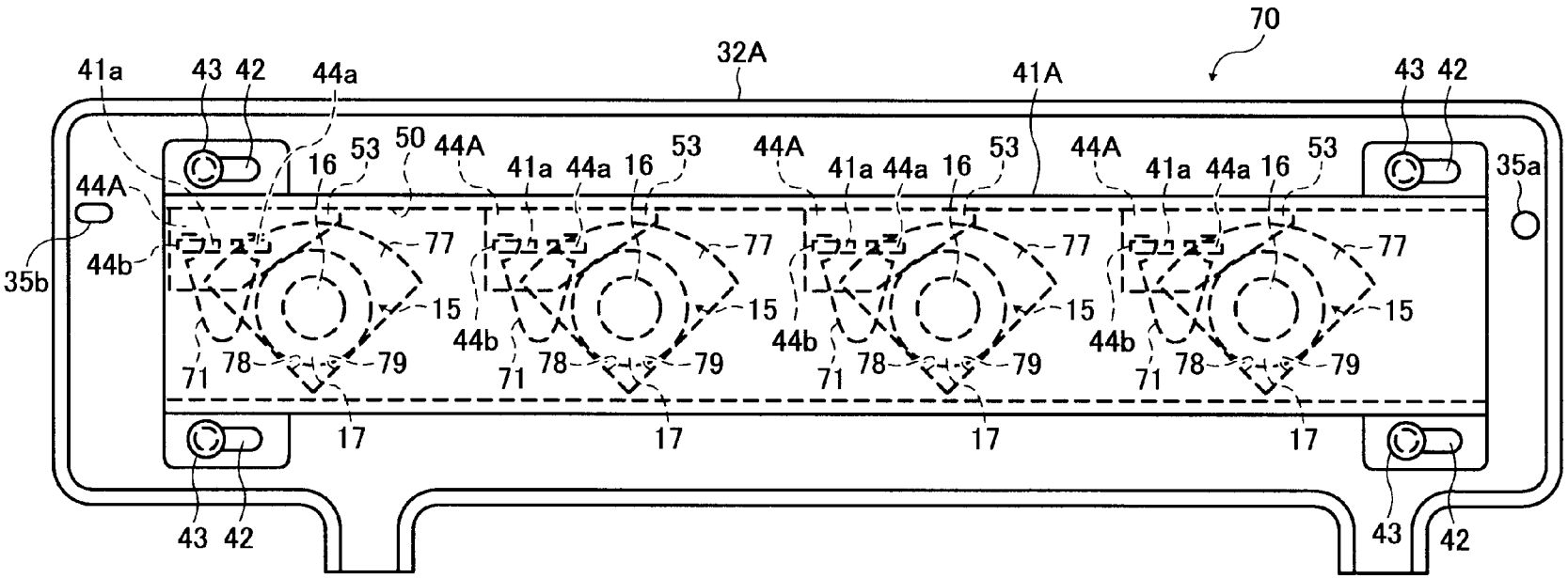
FIG. 11 is a front view of the positioning holding member that is in the closed position and the sliding member placed in a second position according to the second comparative example.
Figure 13:
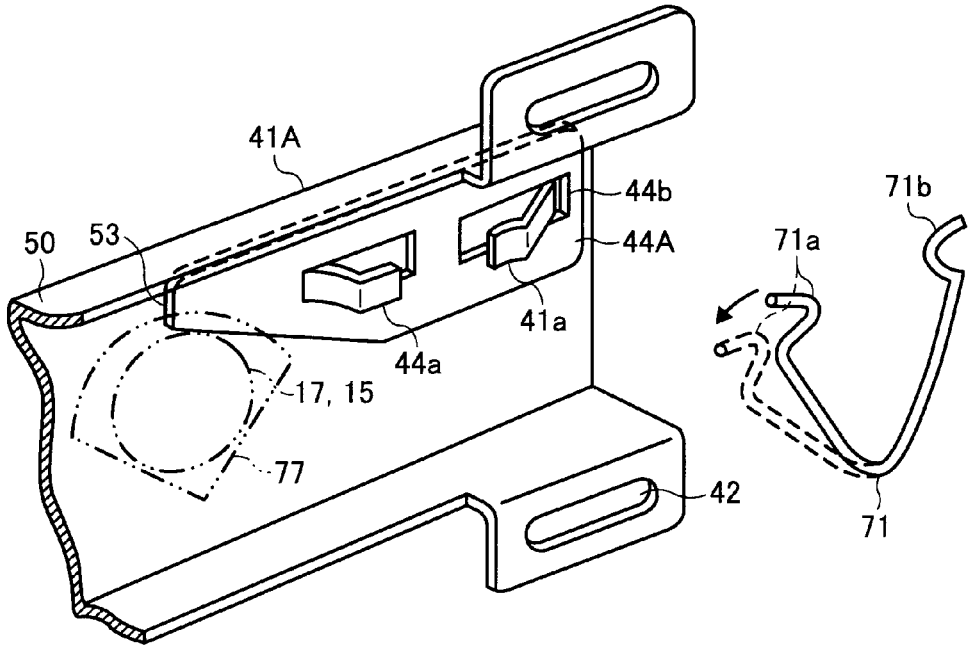
FIG. 13 is an exploded perspective view for explaining how a spring is attached to the positioning holding member with the pressing member according to the second comparative example.
Figure 14:
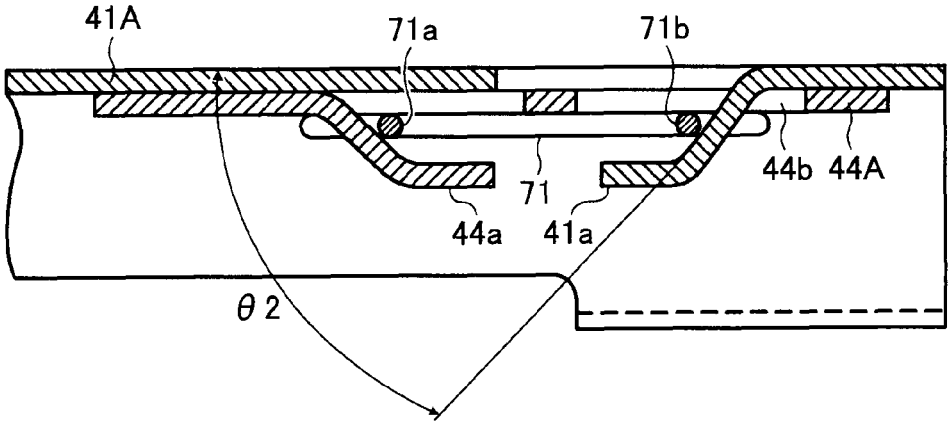
FIG. 14 is a plan cross section of a relevant part for explaining the relationship between a bending angle of cut-and-bent members on the sliding member and the attachment of the spring.
Figure 15:
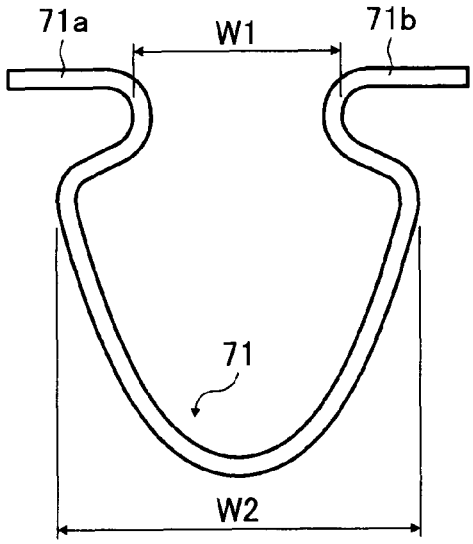
FIG. 15 is a schematic for explaining the shape of the spring in detail.
Figure 16:
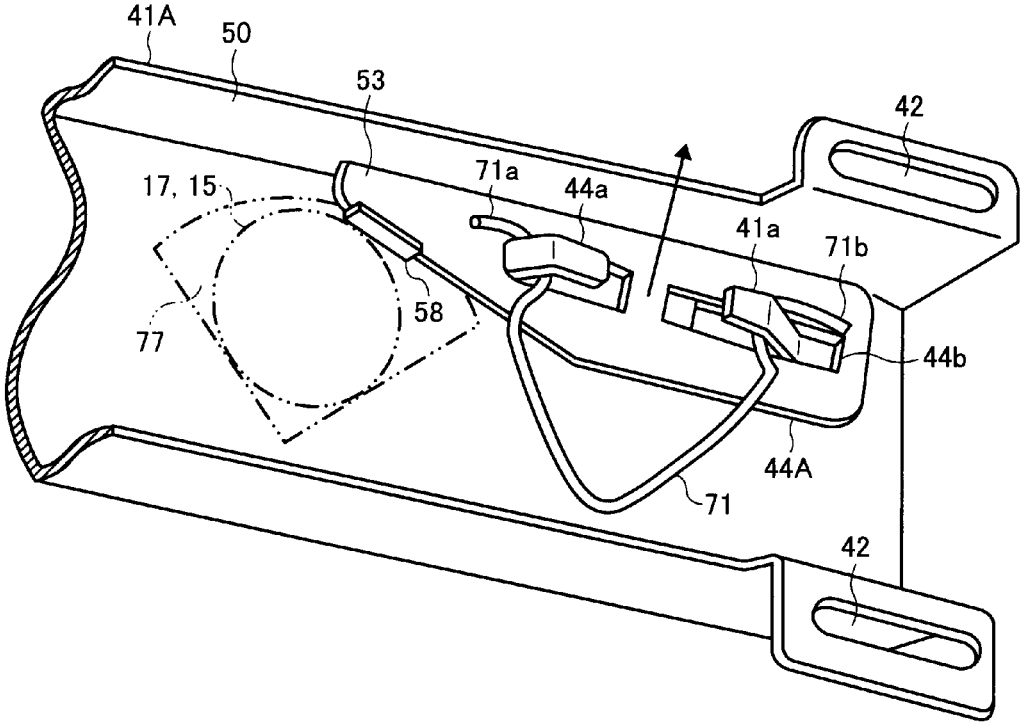
FIG. 16 is a perspective view of a relevant part after the spring is attached to the positioning holding member with the pressing member according to the second comparative example.
Figure 17:
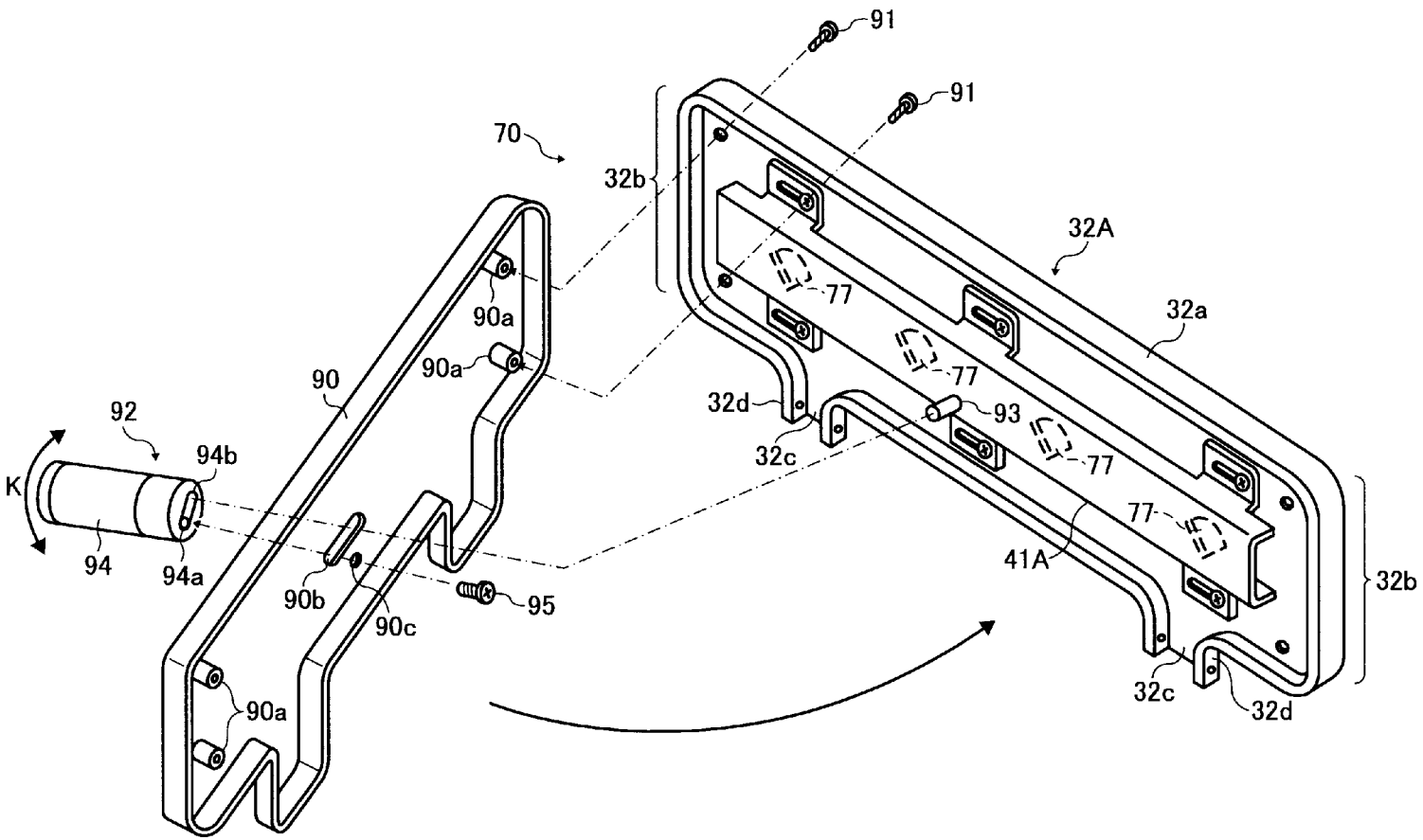
FIG. 17 is an exploded perspective view of the surroundings of the positioning holding member, the sliding member, and a cover of the positioning unit according to the second comparative example.

The positioning unit 70 is different from the positioning unit 65 in that the positioning holding member 32A shown in FIGS. 8 to 11 is used instead of the positioning holding member 32, the sliding member 41A that includes pressing units shown in FIGS. 10, 11, 15, etc. is used instead of the sliding member 41, and the pressing members 44A in the pressing units shown in FIGS. 10 to 15 are used instead of the pressing members 44. Further, the stoppers 49, which are structured by the shoulder screws, are eliminated, and the springs 71 in the pressing units shown in FIGS. 10 to 16 are used instead of the tension springs 52. In addition, the cover 90 shown in FIG. 17 is additionally provided to oppose the positioning holding member 32A on the outside thereof, with the sliding member 41A interposed therebetween, and a moving unit 92 including the operation lever 94 shown in FIG. 17 for moving the sliding member 41A between the first position and the second position is provided. Except for these differences, the positioning unit 70 is basically the same as the positioning unit 65.

As shown in FIGS. 8 to 11, 17, and the like, the positioning unit 70 includes the positioning holding member 32A as a holding member that has the sets of two planes 78 and 79 as the holding portions, and the pressing units (described later) that respectively press and position the carrier supporting members 15 that are held by the two planes 78 and 79. Each set of two planes 78 and 79 is provided in the four openings as the attachment holes 77 in which the carrier supporting members 15 are respectively held by the weight of the process cartridges 1Y, 1C, 1M, and 1BK when the positioning unit 70 is closed on the opening 31 in the front board 28 of the image forming apparatus 7

Like in the first comparative example, the positioning holding member 32A, the sliding member 41A, the pressing members 44A, and the like are integrally formed together with the other elements described below, using sheet metal that serves as a board member. Thus, an advantageous effect is achieved where it is possible to structure the constituent elements at an extremely low cost while a predetermined level of strength, anti-abrasion characteristics, and durability are assured.

The positioning holding member 32A is different from the positioning holding member 32 in that the attachment holes 77 are provided instead of the attachment holes 37, and also that the strength of the positioning holding member 32A is enhanced, although the explanation for the positioning holding member 32 was omitted.

As shown in FIG. 9, with each of the openings as the attachment holes 77, tongues 80 and 81 are integrally formed, the tongues 80 and 81 having the two planes 78 and 79 that serve as the holding portions by which a corresponding one of the carrier supporting members 15 is held by the weight of the corresponding one of the process cartridges 1Y, 1C, 1M, and 1BK. The tongues 80 and 81 having the two planes 78 and 79 are provided on either side of a substantially vertical line while forming a substantially equal angle (approximately 45°) from the substantially vertical line and being substantially orthogonal to each other. This arrangement makes it possible to have the same function as that of two planes in V-blocks that are used in finding the core of a shaft made of a round bar.

Figure 6:
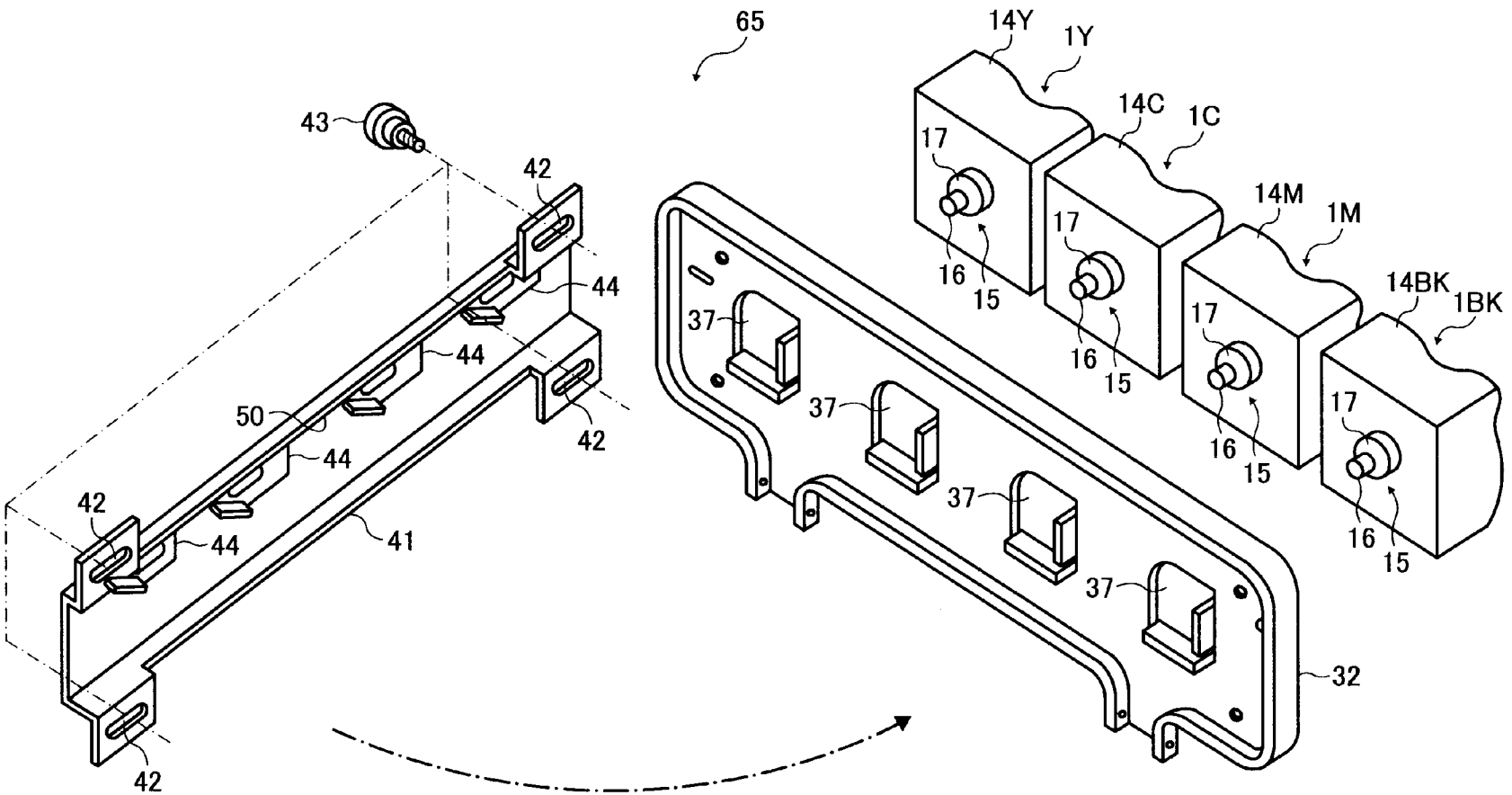
FIG. 6 is an exploded perspective view of the sliding member, the positioning holding member, and the process cartridges according to the first comparative example.
Figure 7:
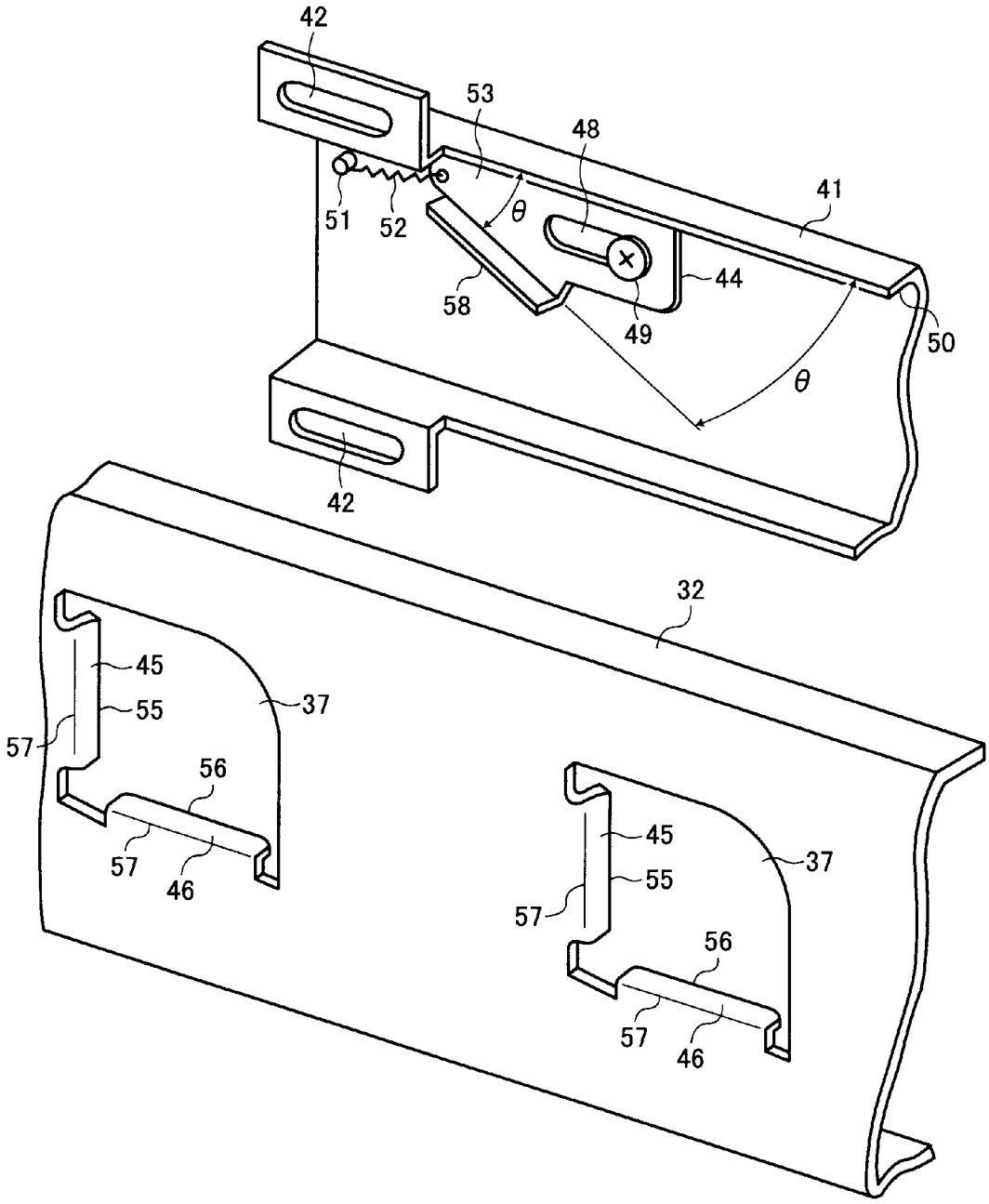
FIG. 7 is a perspective view of the positioning holding member and the sliding member viewed from the inside of the image forming apparatus according to the first comparative example.

On the other hand, when the carrier supporting members 15 are held and positioned using the attachment holes 37 each of which has the vertical plane 45 and the horizontal plane 46 that are shown in FIGS. 6 and 7, there is a possibility that the carrier supporting members 15 are not securely placed and held on the two planes 45 and 46 by the weight of the process cartridges 1Y, 1C, 1M, and 1BK. Even if the pressure from each of the pressing members 44 is applied, there is a possibility that each carrier supporting member 15 is not held in a proper position because the carrier supporting member 15 is stuck at the horizontal plane 46 and, especially, is not in contact with the vertical plane 45. The second comparative example aims to provide a solution to this problem.

Like in the first comparative example shown in FIG. 7, when the two planes 78 and 79 are formed as the tongues 80 and 81 that are shaped as a result of a cut-and-bend process performed during the press molding process, the basal portion of each of the tongues 80 and 81 has a curved portion. Thus, when the positioning holding member 32A is swung to the closed position in the direction indicated by the arrow D in FIG. 8, the curved portions slide and become in contact with the bearings 17. Consequently, it is possible to avoid a problem where the bearings 17 are damaged.

If there is no need to achieve such an advantageous effect, another arrangement is acceptable in which the tongues 80 and 81 are not formed, but the carrier supporting members 15 are held by the sectioned planes (sheared planes) of the attachment holes 77 that correspond to the thickness of the board. The tongues 80 and 81 are shown only in FIGS. 8 and 9 to simplify the drawings and are omitted from the other drawings. Also, the shape of the attachment holes 77 is shown precisely only in FIG. 9. In other drawings, each of the attachment holes 77 is simply shown as being in a substantially fan shape.

Needless to say, the level of precision in the dimension of the positioning holding member 32A with respect to the frame 33, the length of the pitch between the two planes 78 and 79 in each of the attachment holes 77 of the positioning holding member 32A and the size of the constituent elements are set to be within a predetermined precision range (a predetermined tolerance) so that the photosensitive drums 6Y, 6C, 6M, and 6BK can be positioned with respect to the image forming apparatus 7.

As shown in FIG. 17, the cover 90 is integrally formed by using an appropriately selected resin that has a predetermined level of strength to satisfy the function thereof. On the right end and the left end of the cover 90, bosses 90*a* used for fastening screws 91 are provided so as to project from the cover 90. On the other hand, on either end of the positioning holding member 32A, holes through which the screws 91 are to be inserted are provided. The cover 90 and the positioning holding member 32A are fastened and fixed to each other by the screws 91. The positions at which the cover 90 and the positioning holding member 32A are fixed to each other by the screws 91 are located on the outer side of the four attachment holes 77 having the holding portions. With this arrangement, the strength of the positioning holding member 32A is assured. This arrangement is especially effective in enhancing the strength against torsions.

As shown in FIG. 17, the positioning holding member 32A is formed by drawing at least one of the longer sides and the shorter sides on either end thereof to obtain a drawn portion 32*a*. A flange is formed on the entire periphery of the positioning holding member 32A. With these arrangements, the strength of the positioning holding member 32A is assured more sufficiently.

In addition, the part of the positioning holding member 32A from carrier supporting member holding portions 32*b* to portions 32*c* that are fitted with the swing supporting point of the positioning holding member 32A (see the hinge pins 34 shown in FIGS. 8 and 9) is configured to be an integrally-formed structure. The portions 32*c* and the parts extending to the carrier supporting member holding portions 32*b* are joined to each other by the flange formed as a drawn portion 32*d*. With these arrangements, it is possible to further assure the strength in the part of the positioning holding member 32A from the swing supporting point to the carrier supporting member holding portions 32*b*.

As shown in FIGS. 8 to 17, the pressing units in the second comparative example include the plurality of (four in the second comparative example) pressing members 44A in correspondence with the carrier supporting members 15 for the process cartridges 1Y, 1C, 1M, and 1BK each of which is configured to be able to move between the non-pressing position and the pressing position. The non-pressing position indicates a position at which each pressing member 44 is not in contact with the corresponding one of the carrier supporting members 15 that are placed on the two planes 78 and 79, and the pressing position indicates a position at which each pressing member 44 presses and positions the corresponding one of the carrier supporting members 15 that are placed on the two planes 78 and 79. The pressing units further include the plurality of (four in the second comparative example) springs 71 in a U-shape as the biasing units that bias the pressing members 44A in such a direction that the pressing members 44A are moved toward the pressing positions, and the sliding member 41A that movably supports the pressing members 44A and also serves as a movable member being movably supported by the positioning holding member 32A in such a manner that the sliding member 41A is able to move between the first position shown in FIG. 10 corresponding to the non-pressing position and the second position shown in FIG. 11 corresponding to the pressing position.

The sliding member 41A includes the guiding plane 50 that serves as a guiding unit that guides each of the pressing members 44A between the non-pressing position and the pressing position and a plurality of cut-and-bent members 41*a* that serve as stoppers to regulate and hold each of the pressing members 44A to be in the non-pressing positions when the sliding member 41A is in the first position. The cut-and-bent members 41*a* also serve as first seizing units that are provided near the attachment holes 77.

As explained above, the sliding member 41A is different from the sliding member 41 shown in FIG. 6 etc. in that the pins 93 are provided in the moving unit 92, the stoppers 49 are eliminated, and the cut-and-bent members 41*a* are provided.

Each of the pressing members 44A has the wedge-shaped part 53 that is pressed into a position between the guiding plane 50 and the corresponding one of the carrier supporting members 15 that are placed on the two planes 78 and 79 and presses the carrier supporting member 15. As shown in FIG. 16 only, like in the pressing members 44 that are the constituent elements according to the first comparative example shown in FIG. 7, if the plane of each of the pressing members 44A that is in contact with the corresponding one of the bearings 17 for the carrier supporting members 15 is formed as the tongue 58 shaped as a result of a cut-and-bend process performed during the press molding process, the basal portion of the tongue 58 has a curved portion. Thus, when the pressing members 44A abut against the bearings 17 for the carrier supporting members 15, it is possible to avoid a problem where the bearings 17 are damaged.

Figure 12:
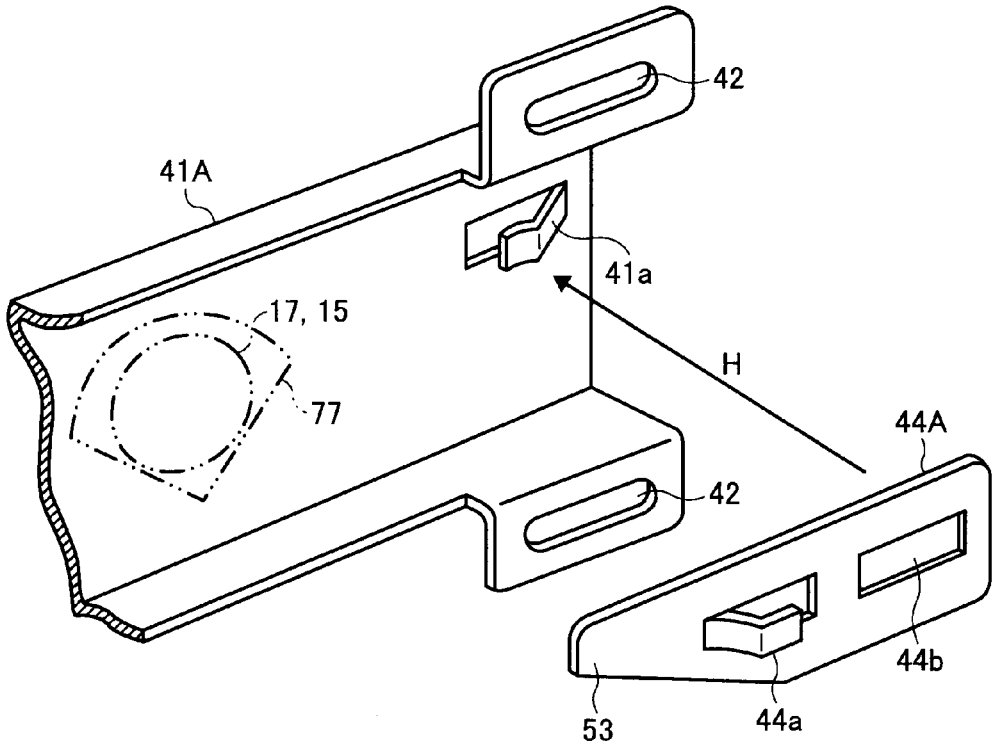
FIG. 12 is an exploded perspective view for explaining how a pressing member is attached to the positioning holding member according to the second comparative example.

In each of FIGS. 12, 13, 16, and the like, the fan shapes and the circles drawn with a double-dashed line on the internal surface of the web of the sliding member 41A indicate how the attachment hole 77 and the bearing 17 for the carrier supporting member 15 are virtually situated, so that the positioning holding member 32A can be omitted from the drawings and the drawings are simplified.

Provided in each of the pressing members 44A having the wedge-shaped parts 53 in a tapered shape, like according to the first comparative example, is an oblong hole 44*b* that is placed in a position in correspondence with a corresponding one of the cut-and-bent members 41*a* on the sliding member 41A within a movement range between the non-pressing position and the pressing position and also a cut-and-bent member 44*a* that opposes the cut-and-bent member 41*a* and has a shape being the reverse of the shape of the cut-and-bent member 41*a*. The sliding member 41A and each of the pressing members 44A are loosely fitted with each other as indicated by an arrow H in FIG. 12. The sliding member 41A and the pressing members 44A are arranged so that, as shown in FIG. 13, the cut-and-bent members 41*a* and the cut-and-bent members 44*a* oppose one another, respectively.

Hooks 71*a* and 71*b* at both ends of each of the springs 71 are hooked and attached between each pair of the cut-and-bent members 41*a* and 44*a*, the springs 71 each being a U-shaped biasing unit and a resilient member. Due to the resilient force of each of the springs 71, the pressing members 44A are held against the sliding member 41A, and a tension is applied between the pressing members 44A and the sliding member 41A.

The bending angle θ2 that is formed by each of the cut-and-bent members 41*a* on the sliding member 41A and serves as a seizure angle for seizing the spring 71 is arranged to be 45° or larger with respect to the sliding-contact movement surface of the sliding member 41A, as shown in FIG. 14. It is not desirable if the bending angle θ2 is smaller than 45° because the hook 71*b* of the spring 71 is more likely to be caught between the cut-and-bent member 41*a* on the sliding member 41A and each pressing member 44A, and the movement of the pressing members 44A is hindered.

The shape of each of the springs 71 will be explained in detail, with reference to FIG. 15. Each of the springs 71 is substantially in a U-shape. On both ends of each spring 71, the hooks 71*a* and 71*b* are provided so that the spring 71 can be hooked onto the cut-and-bent members 41*a* and 44*a* on the sliding member 41A and each of the pressing members 44A.

The width W1 between inner bends of the hooks 71*a* and 71*b*, which is also the width between the two ends of the opening of the U-shaped portion of the spring 71, is arranged to be smaller than the largest width W2 of the U-shaped portion. Needless to say, each of the ends is shaped in such a form that can be hooked. By arranging the widths so that W1<W2 is satisfied, it is possible to prevent each of the springs 71 from moving upward in the direction indicated by an arrow in FIG. 16 due to the tension of the spring 71.

Needless to say, the load and the constant of each of the springs 71 is arranged in consideration of the relationship between the total loads of the four springs being used in the second comparative example and the operational force and also so that resonance of the springs can be avoided.

According to the second comparative example, the hooks 71*a* and 71*b* of each of the substantially U-shaped springs 71 are hooked and attached between the corresponding one of the cut-and-bent members 41*a* on the sliding member 41A and the corresponding one of the cut-and-bent members 44*a* on the pressing members 44A. Thus, it is possible to hold the pressing members 44A against the sliding member 41A and also to eliminate the stoppers 49 that are the shoulder screws according to the first comparative example shown in FIG. 7. Further, because the springs 71, which are less expensive than the tension springs 52 used in the first comparative example shown in FIG. 7, are used, it is possible to further reduce the cost.

According to the second comparative example, because the bending angle θ2 is arranged to be 45° or larger, the hook 71*b* of the springs 71 are prevented from being caught between the cut-and-bent members 41*a* on the sliding member 41A and the pressing members 44A. Thus, it is possible to make the movement of the pressing members 44A smooth.

Further, according to the second comparative example, the width W1 between the inner bends on the opening side of the U-shaped portion of each spring 71 is arranged to be smaller than the largest width W2 of the U-shaped portion (W1<W2). Thus, it is possible to prevent the springs 71 from moving upward in the direction indicated by the arrow in FIG. 16 due to the tension of the springs 71.

Figure 18:
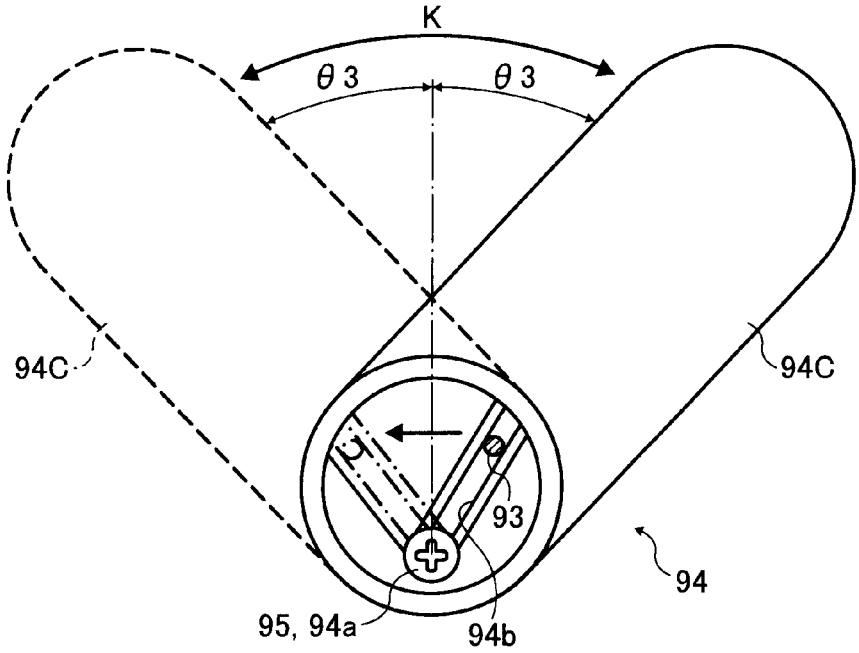
FIG. 18 is a schematic for explaining a movement of an operation lever.

As shown in FIGS. 17 and 18, the moving unit 92 has the function of moving the sliding member 41A between the first position and the second position. The moving unit 92 includes the operation lever 94 on the cover 90 in such a manner that the operation lever 94 is able to reciprocate and swing in predetermined directions indicated by the arrows K in FIGS. 16 and 17, and a reciprocating movement converting unit that converts the reciprocating and swinging movement of the operation lever 94 in the directions indicated by the arrows K to a substantially horizontal and linear movement, which is the movement of the sliding member 41A. The operation lever 94 is normally formed integrally by using an appropriately selected resin to reduce the cost and the weight.

The reciprocating movement converting unit includes the pin 93 on the sliding member 41A, an oblong hole 90*b* through which the pin 93 is inserted and that is formed in the cover 90 to extend substantially in the horizontal direction, the rotation shaft 94*a* that goes through a hole 90*c* in the cover 90 to be fastened and fixed by a screw 95 and serves as a swinging center axis of the operation lever 94, the guiding groove 94*b* at the basal portion of the operation lever 94 and into which the pin 93 is fitted, and the handle unit 94*c* to which an operational force for the operation lever 94 is actually applied.

The reciprocating and swinging movement of the operation lever 94 in the directions indicated by the arrows K is converted into the substantially horizontal movement of the sliding member 41A, when the pin 93 moves along the guiding groove 94*b*, and also the pin 93 is guided and regulated to move along the horizontal direction within the oblong hole 90*b*, using the screw 95 in the rotation shaft 94*a* as the center.

Next, the operation of the positioning unit 70 according to the second comparative example will be explained with reference to FIGS. 8 to 11, and also the detailed configuration will be additionally explained, although some of the explanation may be duplicated.

FIG. 10 shows a situation in which the process cartridges 1Y, 1C, 1M, and 1BK are pushed in toward the back of the image forming apparatus 7 as indicated by the arrow G in FIG. 8, the positioning holding member 32A has been swung to the closed position, the positioning holes 35*a* and 35*b* in the positioning holding member 32A are fitted with the positioning pins 36*a* and 36*b* provided so as to project from the front board 28 (see FIGS. 2 and 3), and the positioning holding member 32A is positioned in the predetermined attachment position. With reference to FIG. 2 like in the first comparative example, FIG. 10 is obtained by viewing in the direction of the arrow IV in FIG. 2.

A plurality of the oblong holes 42 that extend in the horizontal direction are provided in the sliding member 41A. The shoulder screws 43 are inserted into the oblong holes 42 respectively, in such a manner that the shoulder screws 43 are slidable relatively. The shoulder screws 43 are screwed into the positioning holding member 32A. As a result, the sliding member 41A is supported by the positioning holding member 32A in such a manner that the sliding member 41A is slidable and movable in the horizontal direction between the first position shown in FIG. 10 and the second position shown in FIG. 11.

When the positioning holding member 32A is swung from the open position shown in FIG. 8 to the closed position shown in FIG. 10, the bearings 17 are fitted into the attachment holes 77 in the positioning holding member 32A. In this situation, as understood from FIG. 10, the size of each of the attachment holes 77 is arranged to be larger than the cross section area of each of the supporting shafts 16 and each of the bearings 17 that are fitted with the supporting shafts 16. Thus, the bearings 17 are fitted into the attachment holes 77 respectively with a lot of play. Accordingly, the bearings 17 are easily fitted into the attachment holes 77, respectively.

The pressing members 44A are provided in correspondence with the bearings 17. Each of the pressing members 44A is able move in the horizontal direction, relative to the sliding member 41A and with predetermined strokes, while sliding on and being in contact with the guiding plane 50 and being guided by the guiding plane 50, and also being guided by the cut-and-bent members 41*a* that are fitted in the oblong holes 44*b*.

As explained above, the two ends of each of the U-shaped springs 71 are hooked onto the corresponding one of the cut-and-bent members 44*a* on the pressing members 44A and the corresponding one of the cut-and-bent members 41*a* on the sliding member 41A, respectively. With this arrangement, the pressing members 44A are biased toward the right side direction in FIG. 10. However, while the sliding member 41A is placed in the first position shown in FIG. 10, the lanced basal portion of each of the cut-and-bent members 41*a* on the sliding member 41 works as a stopper by abutting against the right end (in the drawing) of the oblong hole 44*b* in each of the pressing members 44A, due to the biasing force of the spring 71, as shown in FIG. 10. Thus, the pressing members 44A are stopped at the positions shown in FIG. 10. In this situation, the pressing members 44A are not in contact with the bearings 17 for the carrier supporting members 15.

As explained so far, the pressing members 44A are slidably and movably supported by the sliding member 41A, while being biased by the springs 71. While the sliding member 41A is in the first position, the pressing members 44A that are biased by the springs 71 are regulated by the cut-and-bent members 41*a* on the sliding member 41A and are prevented from being in contact with the carrier supporting members 15. Thus, when an operator has manually swung the positioning holding member 32A from the open position to the closed position shown in FIG. 10, the bearings 17 do not interfere with the pressing members 44A and are able to be fitted into the attachment holes 77, respectively.

Next, when the operator turns the operation lever 94 shown in FIGS. 17 and 18 against a resultant force from the biasing forces of the four springs 71 and the friction resistance in the sliding-contact portions of the pressing members 44A with respect to the sliding member 41A, so that the sliding member 41A shown in FIG. 10 slides to the right side and is placed in the second position shown in FIG. 11, the wedge-shaped parts 53 in the pressing members 44A are pressed into the positions between the guiding plane 50 and the bearings 17 for the carrier supporting members 15. Thus, each of the bearings 17 is pressed against the two planes 78 and 79 that divide the corresponding one of the attachment holes 77 into sections. The action in this situation will be explained in details.

When the sliding member 41A starts being moved from the first position shown in FIG. 10 to the second position shown in FIG. 11, each of the pressing members 44A that are biased by the springs 71 and regulated by the cut-and-bent members 41*a* fitted into the oblong holes 44*b* starts moving toward the right side in FIG. 10, together with the sliding member 41A. Subsequently, when the sliding member 41A has reached a predetermined position located between the first position and the second position, each of the wedge-shaped parts 53 in the pressing members 44A that are biased by the springs 71 is pressed into the position between the guiding plane 50 and the corresponding one of the bearings 17 for the carrier supporting members 15 and is stopped when being pressed against and in contact with the outer circumferential surface of the bearing 17. As a result, each of the pressing members 44A intensely presses the corresponding one of the bearings 17 against the two planes 78 and 79 of a corresponding one of the attachment holes 77.

Even after each of the pressing members 44A has stopped, when the sliding member 41A is moved toward the second position against the biasing forces of the springs 71, the end of each of the oblong holes 44*b* in the pressing members 44 comes away from a corresponding one of the cut-and-bent members 41*a*. Thus, the pressing members 44A are released from the regulation of the cut-and-bent members 41*a*.

As explained above, due to the pressing forces of the wedge-shaped parts 53 in the pressing members 44A that are biased by the springs 71, each of the bearings 17 is pressed against and in contact with the two planes 78 and 79 in the corresponding one of the attachment holes 77. As a result, the carrier supporting members 15 and the portions on the front side of the photosensitive drums 6Y, 6C, 6M, and 6BK that are supported by the carrier supporting members 15 are positioned properly with respect to the positioning holding member 32A. In this situation, to explain with reference to FIG. 8, while partially referring to FIG. 2, because the positioning holding member 32A is positioned properly with respect to the frame 33, it means that the photosensitive drums 6Y, 6C, 6M, and 6BK are properly positioned with respect to the frame 33 of the image forming apparatus 7. The operator is able to position the photosensitive drums 6Y, 6C, 6M, and 6BK with respect to the image forming apparatus 7, by only attaching the positioning holding member 32A in the predetermined position with respect to the frame 33 and moving the sliding member 41A with the operation of the operation lever 94. In addition, the size of the each of the attachment holes 77 in the positioning holding member 32A is set to be much larger than the cross section area of the end of each of the carrier supporting members 15 on the front side. Thus, it is possible to smoothly and easily fit the carrier supporting members 15 into the attachment holes 77 respectively.

Needless to say, the level of precision in the dimension of the positioning holding member 32A with respect to the frame 33, the length of the pitch between the two planes 78 and 79 in each of the attachment holes 77 of the positioning holding member 32A and the size of the constituent elements are set to be within a predetermined precision range (a predetermined tolerance) so that the photosensitive drums 6Y, 6C, 6M, and 6BK can be positioned with respect to the image forming apparatus 7.

As explained above, the pressing units include the plurality of pressing members 44A in correspondence with the carrier supporting members 15 each of which is configured to be able to move between the non-pressing position and the pressing position, the non-pressing position being a position at which each pressing member 44A is not in contact with the corresponding one of the carrier supporting members 15 that are placed at the holding portions (the two planes 78 and 79) and the pressing position being a position at which each pressing member 44A presses and positions the corresponding one of the carrier supporting members 15 that are placed at the holding portions (the two planes 78 and 79); the springs 71 that serve as the biasing units that bias the pressing members 44A in such a direction that the pressing members 44A are moved toward the pressing positions; the sliding member 41A that movably supports the pressing members 44A and is movably supported by the positioning holding member 32A in such a manner that the sliding member 41A is able to move between the first position corresponding to the non-pressing position and the second position corresponding to the pressing position; and the moving unit 92 that moves the sliding member 41A between the first position and the second position.

According to the second comparative example, the operability is even higher and also the costs are further reduced, compared to the first comparative example. According to the second comparative example also, the positions of the constituent elements are determined so that, while the sliding member 41A is in the first position, the pressing members 44A biased by the U-shaped springs 71 are regulated by the cut-and-bent members 41*a* on the sliding member 41A as stoppers and are prevented from contacting the carrier supporting members 15 on the two planes 78 and 79. When the sliding member 41A has left the first position for the second position, each of the pressing members 44A that are biased by the U-shaped springs 71 and also regulated by the cut-and-bent members 41*a* moves together with the sliding member 41A. When the sliding member 41A has reached the predetermined position between the first position and the second position, each of the pressing members 44A that are biased by the U-shaped springs 71 is stopped because the wedge-shaped part 53 in each pressing member 44A is pressed into the position between the guiding plane 50 and the corresponding one of the carrier supporting members 15 placed on the two planes 78 and 79. The positions of the sliding member 41A, the pressing members 44A, the U-shaped springs 71, and the cut-and-bent members 41*a* are arranged so that, when the sliding member 41A further moves toward the second position, the pressing members 44A are released from the regulation of the cut-and-bent members 41*a*.

According to the second comparative example, like according to the first comparative example, when the sliding member 41A is placed in the second position shown in FIG. 11, the wedge-shaped part 53 in each of the pressing members 44A is pressed into the position between the guiding plane 50 and the outer circumferential surface of the corresponding one of the bearings 17. Thus, each of the carrier supporting members 15 is held in the proper position by the frictional force and the biasing force of the corresponding one of the springs 71. Consequently, it is possible to keep the photosensitive drums 6Y, 6C, 6M, and 6BK positioned properly. Also, when the sliding member 41A is returned to the first position shown in FIG. 10 with a manual operation, each of the pressing members 44A comes away from the outer circumferential surface of the corresponding one of the bearings 17. Thus, it is possible to swing the positioning holding member 32A to the open position shown in FIG. 8, without any hindrance.

Further, according to the second comparative example, as for the parts that have the same configurations as in the first comparative example and are other than the parts being characterized with the features according to the second comparative example explained above, these parts exert the same advantageous effects as in the first comparative example, needless to say. In other words, when the positioning unit 70 is closed on the image forming apparatus 7, after the bearings 17 (the carrier supporting members 15) are held on the two planes 78 and 79 (the holding portions) in the openings as the attachment holes 77 by the weight of the process cartridges 1Y, 1C, 1M, and 1BK (the image carrier units), the bearings 17 that are placed on the two planes 78 and 79 are pressed and positioned by the pressing units. Thus, with the simple configuration, it is possible to properly position the process cartridges 1Y, 1C, 1M, and 1BK with respect to the image forming apparatus 7. In addition, it is also possible to provide the image forming apparatus of which the operability is enhanced and the cost is reduced.

First Embodiment

Figure 19:
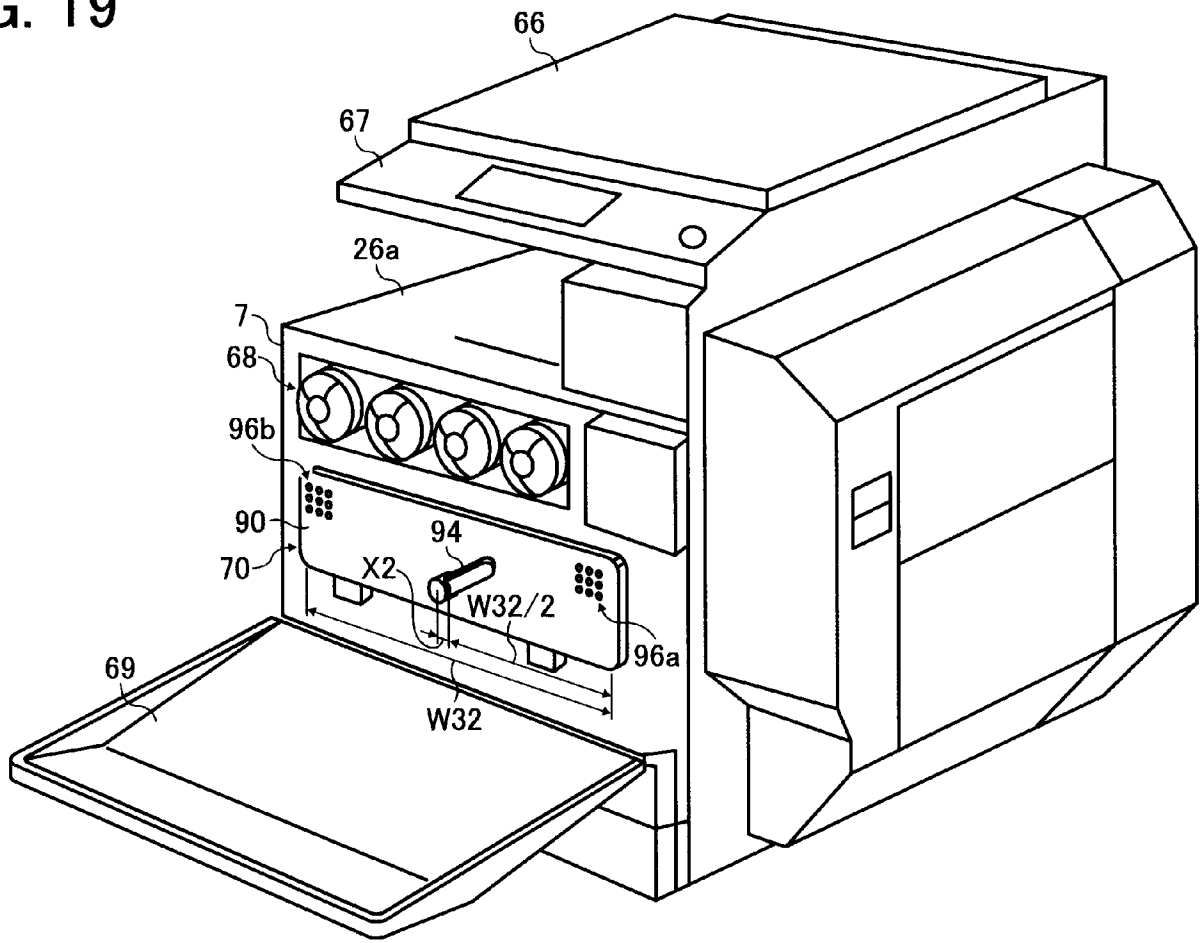
FIG. 19 is a perspective view of a relevant part of an image forming apparatus with a front cover open to expose the positioning unit and pressing position indicators according to a first embodiment of the present invention.

A first embodiment of the present invention will be explained. FIG. 19 is a schematic of an image forming apparatus according to the first embodiment, which is shown in slightly more detail than the image forming apparatuses according to the first and the second comparative examples.

The image forming apparatus includes a paper ejecting unit including a paper ejecting tray 26*a*, a scanner unit 66 that reads images and the like from an original, an operation panel 67 as an operating unit, a toner bottle housing 68 that houses therein toners for mutually different colors as developers, a front cover 69 that is arranged to face an operator. The front cover 69 covers the toner bottle housing 68, the positioning unit 70, and the like, and is configured to freely opened and closed with respect to the image forming apparatus 7.

Figure 20:
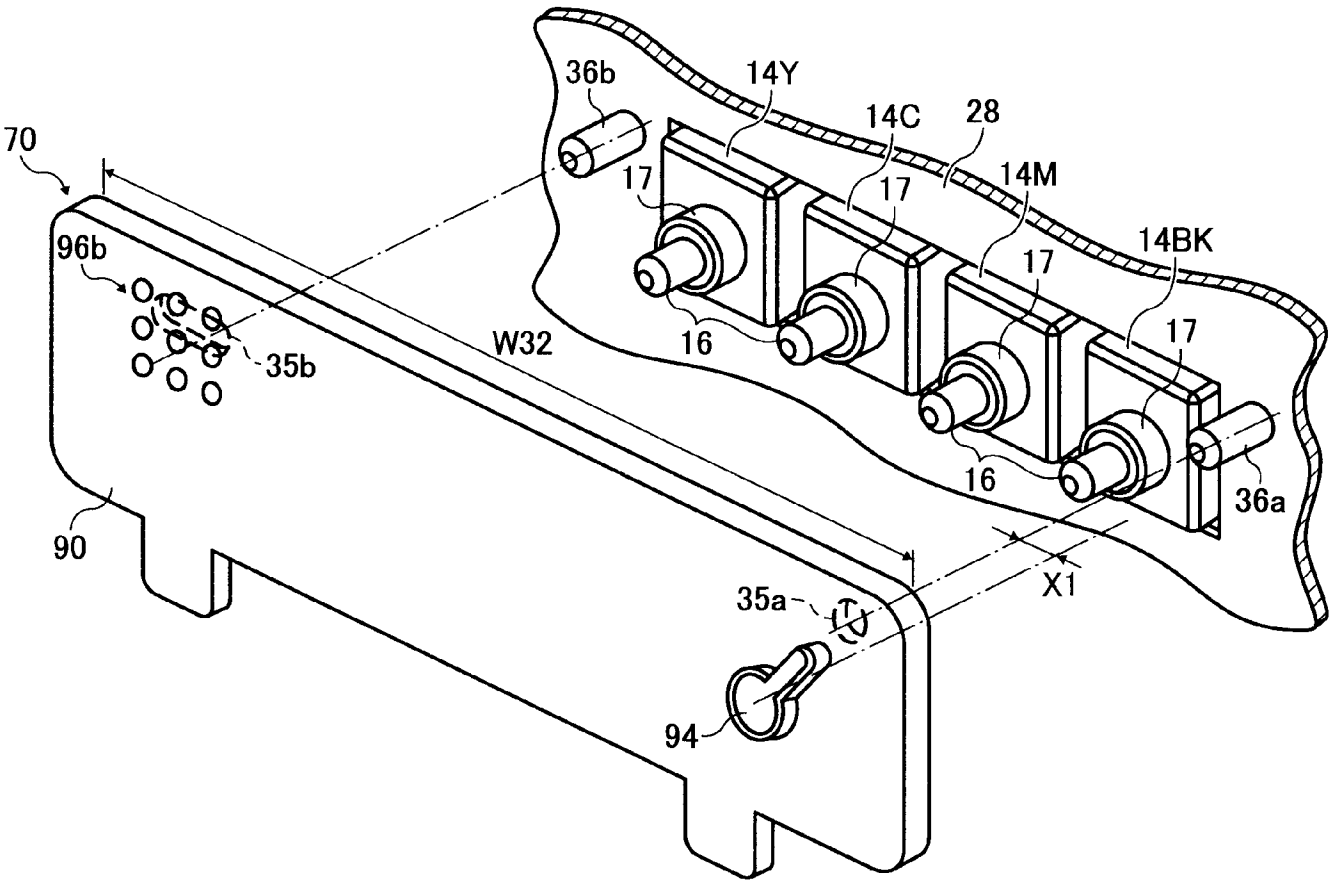
FIG. 20 is an exploded perspective view of a relevant part for explaining the positional relationship between the operation lever and positioning holes and positioning pins on the positioning holding member, and also explaining a pressing position indicating portion according to a modification of the first embodiment.

The first embodiment is characterized in that the operation lever 94 is provided on the cover 90 at a position opposite to near the middle of the positioning holding member 32A in the longitudinal direction (see FIGS. 8 and 20, because it is covered by the cover 90 and is not shown). Further, the cover 90 includes pressing position indicating projections 96*a* and 96*b* that serve as pressing position indicators at the positions opposite to near the positioning holes 35*a* and 35*b* on the right end and the left end of the positioning holding member 32A. The pressing position indicating projections 96*a* and 96*b* are configured to assist the positioning holes 35*a* and 35*b* in the positioning holding member 32A to be fitted with the positioning pins 36*a* and 36*a* on the image forming apparatus 7 side.

To improve the operability and the workability of the operation lever 94 for the operator, it is preferable if the operation lever 94 is arranged within a distance indicated as "X2", which is equal to or smaller than a quarter of the length W32, on the left or on the right of the point "W32/2" expressing the middle point of the length W32 (the distance between the left end and the right end [in the drawing] of the positioning holding member 32A) of the positioning holding member 32A shown in FIG. 8 and the like. The operation lever 94 shown in FIG. 19 is arranged on the left side of the point "W32/2" within the distance "X2", which is equal to or smaller than a quarter of the length W32, the point "W32/2" expressing the middle point of the length W32. The distance "X2" from the middle point "W32/2" is equal to or smaller than a quarter of the length W32 of the positioning holding member 32A.

The pressing position indicating projections 96*a* and 96*b* are formed like Braille patterns so that each of the projections has a partial spherical surface.

The pressing position indicators do not have to be the pressing position indicating projections 96*a* and 96*b*. For example, instead of the projections (convex shapes), it is acceptable to use concave shapes (which are the opposite of the convex shapes), a text displayed or engraved saying "PRESS" in Japanese or in English, an engraved "symbol with a picture of a hand", or a label sticker with the message.

It is preferable to arrange the pressing position indicating projections 96*a* and 96*b* within a fifth of the length W32 from the positioning holes 35*a* and 35*b* in the positioning holding member 32A, so that the operator is able to press the projections without fail, and also it is possible to assist the positioning holes 35*a* and 35*b* to be fitted with the positioning pins 36*a* and 36*b*, without fail.

As explained above, according to the first embodiment, the operation lever 94 (the operating unit; the operating member) is arranged near the middle (in the surrounding of the middle area) of the positioning holding member 32A. Thus, when an operator sets the positioning holding member 32A with one hand, his/her hand will be placed naturally at the position where a force should be applied. In addition, when the plurality of positioning pins and positioning holes are used, it is effective to press in the middle. In this situation also, the operator's hand will be placed naturally at the position where a force should be applied during the setting process. With these arrangements, it is possible to make it easy even for an operator who is not familiar with the operation of the apparatus to perform the setting process.

In addition, according to the first embodiment, the pressing position indicating projections 96*a* and 96*b* (the pressing position indicators) are provided on the cover near the positions at which the positioning holes 35*a* and 35*b* are fitted with the positioning pins 36*a* and 36*b*, in other words, on the cover 90 at the positions opposite to the portions near the positioning holes 35*a* and 35*b* on the left end and the right end of the positioning holding member 32A. Thus, even if the positioning unit 70 and the cover 90 tend to slightly warp on either end thereof in the left-and-right direction (in the horizontal direction), an operator is able to apply a force, without wasting any, to the predetermined attachment position on the positioning holding member 32 (the positioning unit 70). Also, it is possible to activate a locking device (not shown). Consequently, it is possible to position and set the positioning holding member 32A (the positioning unit 70) with respect to the image forming apparatus 7, without fail. In addition, it is possible to position the four process cartridges 1Y, 1C, 1M, and 1BK accurately. Consequently, needless to say, it is possible to have images in the mutually different colors overlapped accurately, which is important for color image forming apparatuses.

In FIG. 20, a modification of the first embodiment is shown. The modification shown in FIG. 20 is different from the first embodiment in that the operation lever 94 is arranged on the cover at a position opposite to near the positioning hole 35*a* in the positioning holding member 32A, and the pressing position indicating projection 96*b* as a pressing position indicator is arranged on the cover 90 at a position opposite to near the positioning hole 35*b* in the positioning holding member 32A. Except for these differences, the first modification shown in FIG. 20 is basically the same as the first embodiment.

To improve the operability and the workability of the operation lever 94 for the operator, it is preferable if the operation lever 94 is arranged within a distance indicated as "X1", which is equal to or smaller than a quarter of the length W32 of the positioning holding member 32A, on the left or on the right of the positioning hole 35*a* in the positioning holding member 32A (see FIG. 8 and the like). The operation lever 94 shown in FIG. 20 is arranged on the right side of the positioning hole 35*a* within the distance "X1", which is equal to or smaller than a quarter of the length W32 of the positioning holding member 32A.

It is preferable to arrange the pressing position indicating projection 96*b* within a fifth of the length W32 from the positioning hole 35*b* in the positioning holding member 32A, so that the operator is able to press the projection without fail, and also it is possible to assist the positioning hole 35*b* to be fitted with the positioning pin 36*b*, without fail.

As explained above, according to this modification, the operation lever 94 (the operating unit; the operating member) is arranged on the cover 90 at the position opposite to the position near the positioning hole 35*a* in the positioning holding member 32A. Thus, when an operator sets the positioning unit 70, his/her hand will be placed naturally at the position where a force should be applied. Thus, it is possible for the operator to apply the force without wasting any. Consequently, it is possible to make it easy even for an operator who is not familiar with the operation of the apparatus to perform the setting process.

Further, according to this modification, it is possible to achieve the same advantageous effect as the one achieved when the pressing position indicating projection 96*b* (the pressing position indicator) according to the first embodiment is arranged near a position at which the positioning hole 35*b* in the positioning holding member 32A is fitted with the positioning pin 36*b*.

Figure 21:
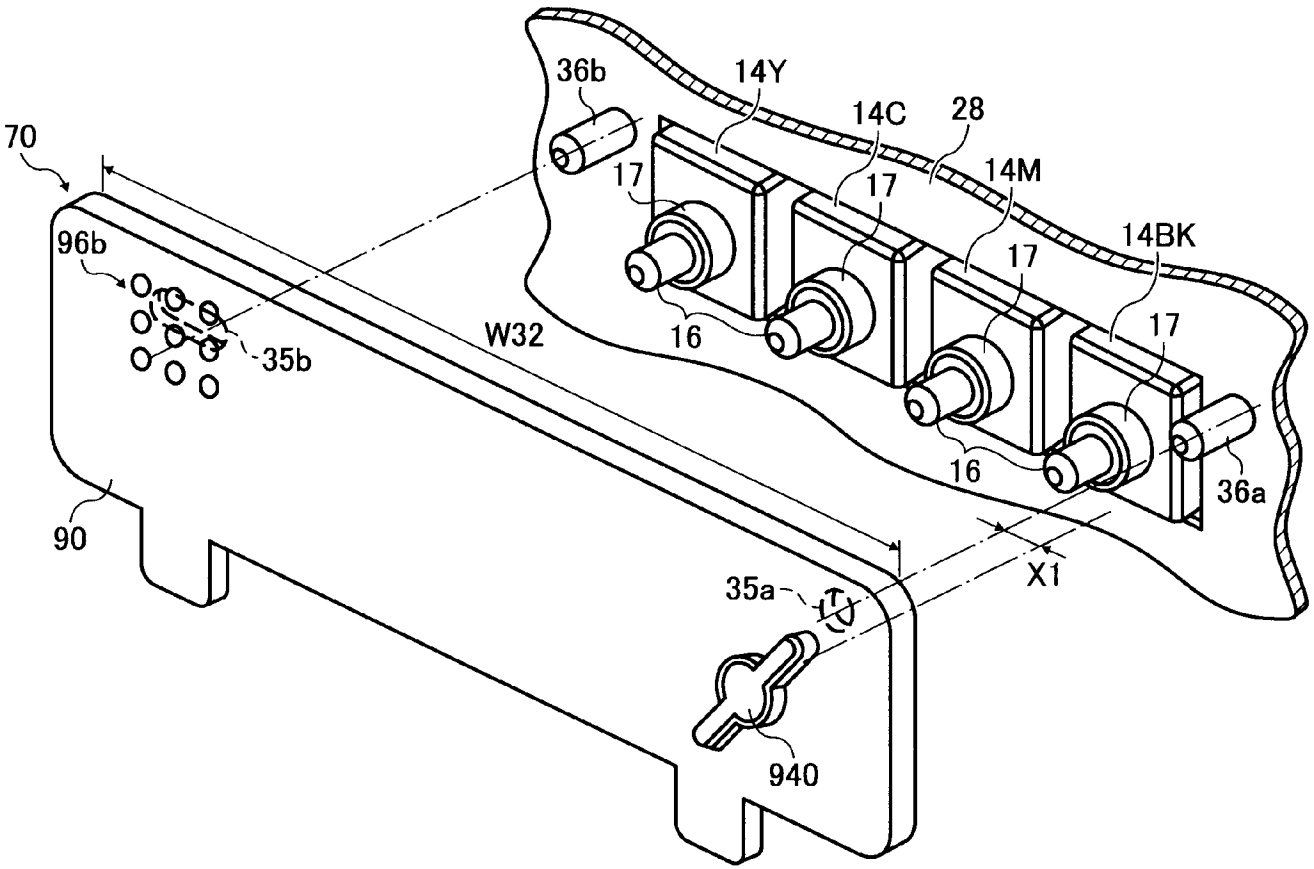
FIG. 21 is an exploded perspective view of a relevant part for explaining the positional relationship between an operation lever and the positioning holes and the positioning pins on the positioning holding member, and also explaining the pressing position indicating portion, according to another modification than the one shown in FIG. 20.

In FIG. 21, another modification obtained by further modifying the modification shown in FIG. 20 is shown. This modification is characterized in that the operating unit is prolonged toward both ends in the distal direction, using the rotation shaft as the center.

The modification shown in FIG. 21 is different from the modification shown in FIG. 20 only in that an operation lever 940, which has been prolonged toward both ends in the distal direction, using the rotation shaft (not shown) as the center, is used instead of the operation lever 94. Except for this difference, the modification shown in FIG. 21 is the same as the modification shown in FIG. 20.

According to this modification, it is possible to achieve the same effect as in the modification shown in FIG. 20. Also, because the operation lever 940 is prolonged toward both ends (in the directions of the radii) in the distal direction, using the rotation shaft as the center, when an operation to slide the sliding member 41A is performed, even if the handle unit of the operation lever 940 is pulled by mistake, a portion of the handle unit on the other side of the rotation shaft functions as a bracing mechanism. Thus, it is less likely that a force is applied in such a way that the operation lever 940 is broken. Thus, it is possible to achieve an advantageous effect where there is a lower possibility that the operation lever 940 may be damaged.

The configuration according to the first embodiment is not limited to the configuration described above. Each of the image forming apparatuses according to the second comparative example, the first embodiment, and the like may have an arrangement in which the operating unit (the operation levers 94 and 940 or the like shown in FIGS. 19 to 21) is prolonged in the direction to be away from the swinging center (the hinge pins 34 shown in FIG. 8 and the like) of the holding member (the positioning holding member 32A shown in FIGS. 8, 17, and the like), and the swinging range (the movable range) is within a range of 45 degrees on the left and on the right of the prolonging direction.

To explain this configuration example with reference to FIGS. 17 and 18 just for the explanation purpose, for example, the swinging range of the operation lever 94 is within a range of the swinging angle θ3=45 degrees on the left and on the right of a perpendicular line (a substantially vertical line) that passes through the rotation shaft 94*a*.

According to this configuration example, the operating unit is prolonged in the direction to be away from the swinging center of the holding member, and also the swinging range (the movable range) is limited to the prolonging direction. Thus, it is possible to locate the tip of the lever at a position that makes the lever ratio of the operating unit effective. Accordingly, it is possible to make it easy for an operator who is not familiar with the operation of the apparatus to perform the setting process. Further, when the movable range of the operating unit is within the range of 45 degrees on the left and on the right of the vertical direction, it is easy for an operator to turn the operating unit no matter whether he/she is right-handed or left-handed. Thus, it is possible to accommodate a large number of users and operators.

Each of the image forming apparatuses according to the first comparative example, the second comparative example, the first embodiment, etc. can have a combination of configurations with regard to the process cartridges (the image carrier units) as follows: the process cartridges are not limited to the process cartridges 1Y, 1C, 1M, and 1BK. For example, the process cartridges may be made up of a combination of the photosensitive drums 6Y, 6C, 6M, and 6BK and at least one of the charging device 11Y that serves as a charging unit, the developing device 9Y that serves as a developing unit, and the cleaning device 10Y that serves as a cleaning unit. Furthermore, the process cartridges do not have to be of such a type that is able to perform full-color image forming process with the four process cartridges 1Y, 1C, 1M, and 1BK. The image forming apparatus may include one or more process cartridges that include a combination of the photosensitive drums and at least one of the charging unit and the developing unit. The same applies to any of the examples mentioned below.

Figure 22:
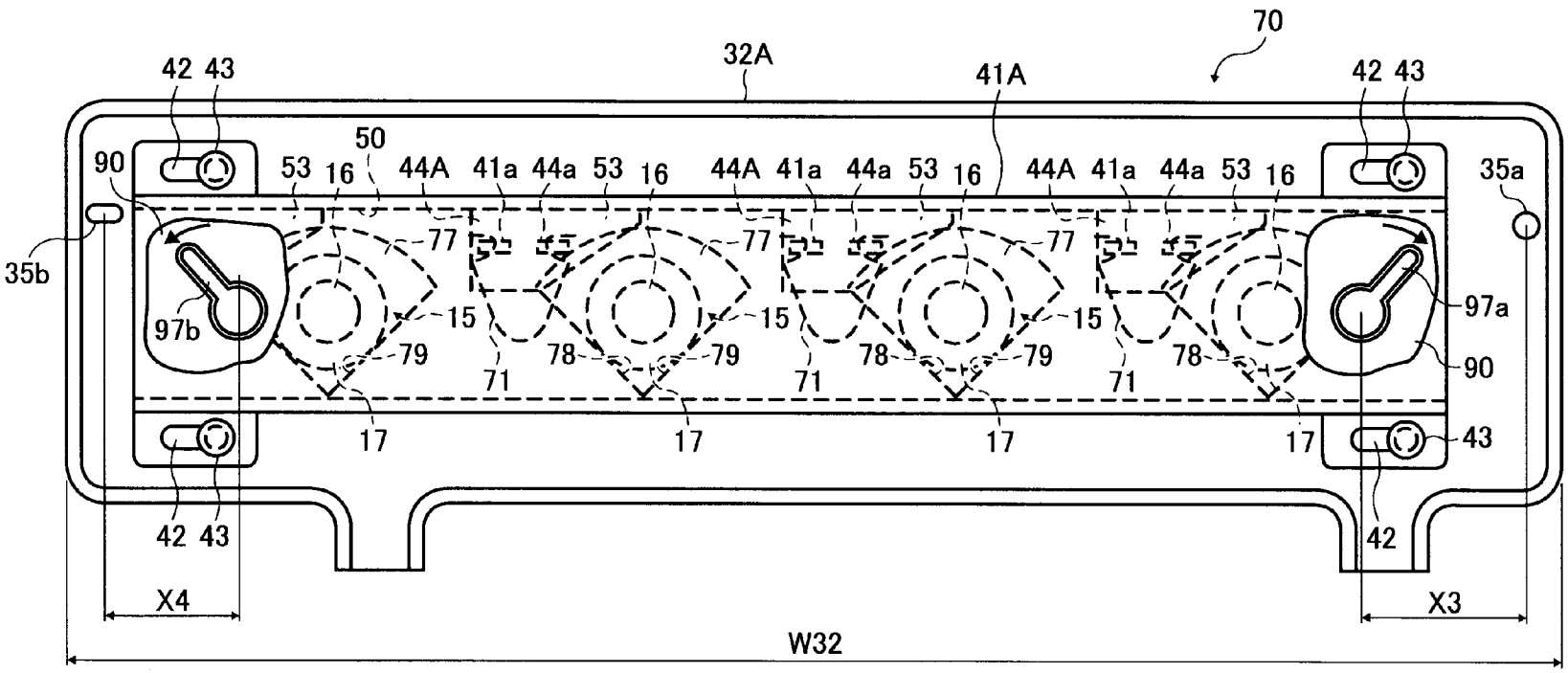
FIG. 22 is a front view for explaining an open state obtained by using operation levers and the positional relationship of the positioning holes in the positioning holding member, according to yet another modification than the ones shown in FIGS. 20 and 21.
Figure 23:
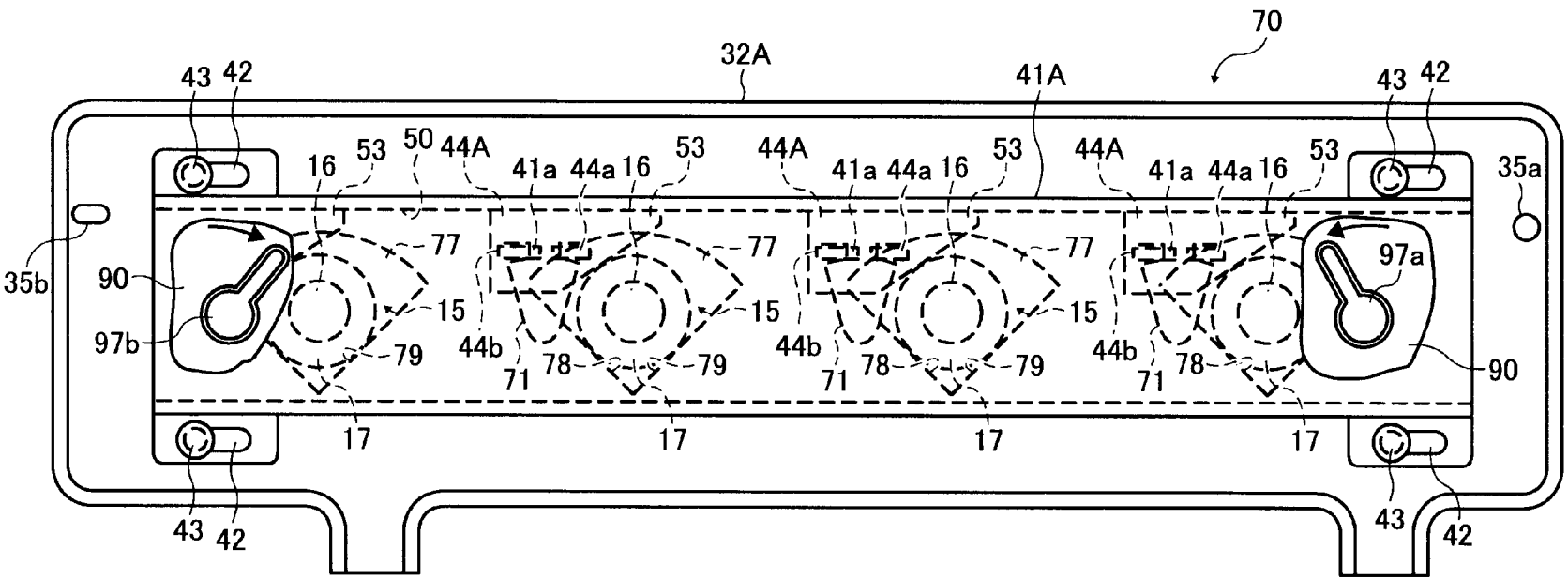
FIG. 23 is a front view for explaining a fixed state obtained by using the operation levers shown in FIG. 22.

In FIGS. 22 and 23, another modification of the first embodiment is shown. This modification is characterized in that the image forming apparatus according to the first comparative example, the second comparative example, the first embodiment, or the like has an arrangement in which operating units for the purpose of fixing are provided at two locations on the holding member near the positioned member so that the holding member is fixed to the positioning member, the operating units being joined to each other by the carrier supporting member.

As shown in FIGS. 8, 22, and 23, in the configuration in which the process cartridges 1Y, 1C, 1M, and 1BK are positioned with respect to the frame 33 of the image forming apparatus 7 by having the positioning pins 36*a* and 36*b* on the front board 28 fitted with the positioning holes 35*a* and 35*b* in the positioning holding member 32A, the rotation shaft (not shown) of a lever 97*a* is arranged at a position that is away from the positioning hole 35*a* in the positioning holding member 32A by a distance "X3", the lever 97*a* serving as an operating unit and being used for having the positioning pin 36*a* fitted with and fixed to the positioning hole 35*a* by using the sliding member 41A. The rotation shaft (not shown) of a lever 97*b* is arranged at a position that is away from the positioning hole 35*b* in the positioning holding member 32A by a distance "X4", the lever 97*a* being used for having the positioning pin 36*b* fitted with and fixed to the positioning hole 35*b* by using the sliding member 41A.

To achieve the effect described below, the distances "X3" and "X4" are arranged to be equal to or smaller than a quarter of the length W32 of the positioning holding member 32A. Another arrangement is acceptable in which one of the two levers 97*a* and 97*b* is configured as a moving unit for sliding and moving the sliding member 41A, and the other of the two levers 97*a* and 97*b* is used as a dummy (that assists the positioning pin 36*b* to be fitted with the positioning hole 35*b*). In such a situation, to make the swinging movement forces of the two levers 97*a* and 97*b* equal to each other, it is acceptable to apply a load resistance to the dummy lever by using a torsion coil spring or the like, so that a strange feeling during the lever operation can be eliminated.

According to this modification, the levers 97*a* and 97*b* are arranged near the positioning pins and the positioning holes. Thus, the operator's hand will be placed naturally at the position where a force should be applied in the setting process. Thus, it is possible to make it easy even for an operator who is not familiar with the operation of the apparatus to perform the setting process. Further, it is possible to suggest that the operation should be performed with both hands. Thus, it is naturally easier to apply the force, and there is a lower possibility that a mistake is made during the setting process. At the same time, it is possible to prevent the operator from having his/her fingers or hands caught. In addition, with the arrangement in which the two levers 97*a* and 97*b* are joined to each other, the operator has to set only one of the levers. Thus, it is possible to operate the apparatus with only one hand.

In the modification sown in FIGS. 22 and 23, a configuration as the following may be applied; the image forming apparatus according to the first comparative example, the second comparative example, the first embodiment, or the like may have an arrangement in which the two operating units are in a fixed state and in a released state in mutually opposite directions.

In the configuration in which the two levers 97*a* and 97*b* are provided for the purpose of having the positioning holes 35*a* and 35*b* in the positioning holding member 32A fitted with and fixed to the positioning pins 36*a* and 36*b*, each of the lever 97*a* and the lever 97*b* is in a fixed state, when they have been swung toward the center direction of the cover 90 as shown in FIG. 21. Each of the lever 97*a* and the lever 97*b* is in a released state as shown in FIG. 22, when they have been swung in the direction opposite to the direction shown in FIG. 21. The combination of the fixed state and the released state may be reversed.

According to this modification, the swinging movement directions of the levers 97*a* and 97*b* on the cover 90 are opposite of each other. Thus, the operation with both hands is easier. In addition, it is easy for an operator to mentally picture the operation of "closing" and "opening". Thus, it is possible to make it easy even for an operator who is not familiar with the operation of the apparatus to perform the setting process.

The configuration related to the pressing position indicators is not limited to the ones according to the first embodiment and the modifications described above. It may be configured as follows:

The image forming apparatus according to the first comparative example, the second comparative example, the first embodiment, or the like that includes only one process cartridge (monochrome) may have an arrangement in which a pressing position indicator indicating a position at which the holding member should be pressed is provided near a magnet fixing unit (a magnet catch or the like) that fixes the holding member by a magnetic force to be within a distance corresponding to a fifth of the length of the holding member.

According to this configuration example, the magnetic fixing unit (a magnet catching unit) and the pressing position indicator are arranged to be close to each other, it is possible to set the holding member to the magnetic fixing unit (the magnet catching unit), without fail.

The image forming apparatus according to the first comparative example, the second comparative example, the first embodiment, or the like may have an arrangement in which a pressing position indicator indicating a position at which the holding member should be pressed is provided near a magnet fixing unit (a magnet catch or the like) that fixes the holding member by a magnetic force to be within a distance corresponding to a fifth of the length of the holding member.

According to this arrangement, in addition to the effect described above, it is possible to accurately position the four process cartridges (the image carrier units). Thus, it is possible to have images in the mutually different colors overlapped accurately, which is important for a color image forming apparatuses.

In the image forming apparatus according to the first comparative example, the second comparative example, the first embodiment, or the like in which the holding member is configured to be able to turn, using a swinging center axis (the hinge pin) positioned by the frame as a center, an arrangement is acceptable in which a pressing position indicator indicating a position at which the holding member should be pressed, within a distance corresponding to a third of the distance from the hinges to a position on the holding member at which the rotation movement distance caused by the hinges is large.

According to this configuration example, due to a leverage action, it is possible to apply a larger force to a positioning groove and an attachment position having the functions of both positioning and locking. Thus, it is possible to perform the positioning and the setting process more securely.

The image forming apparatus according to the first comparative example, the second comparative example, the first embodiment, or the like may have an arrangement in which pressing position displays serving as pressing position indicators are provided in two positions on the left and on the right of the holding member.

According to this configuration example, the displays suggest that the operator should use both hands. Thus, it is possible to enhance security against the possibility of having the operator's hands caught and to solve a problem where vaulting of the holding member hinders the setting process.

The image forming apparatus according to the first comparative example, the second comparative example, the first embodiment, or the like may have an arrangement in which pressing position displays serving as pressing position indicators are provided at positions that include the centers of the position holding members provided on the left and on the right of the holding member.

According to this configuration example, it is possible for the operator to perform the positioning on the left and on the right with one hand and also to perform the setting process using a positioning groove in the positioning member that also has a lock mechanism.

The image forming apparatus according to the first comparative example, the second comparative example, the first embodiment, or the like may have an arrangement in which a pressing position display serving as a pressing position indicator is formed as a projection.

According to this configuration example, it is possible to indicate the pressing position without an increase in the cost.

The image forming apparatus according to the first comparative example, the second comparative example, the first embodiment, or the like may have an arrangement in which a pressing position display serving as a pressing position indicator is formed to have a concave shape.

According to this configuration example, it is possible to form a shape that fits the shape of a hand. Thus, the pressing can be performed with an even lower possibility of errors, in terms of the pressing direction and the pressing position.

Second Embodiment

Figure 24:
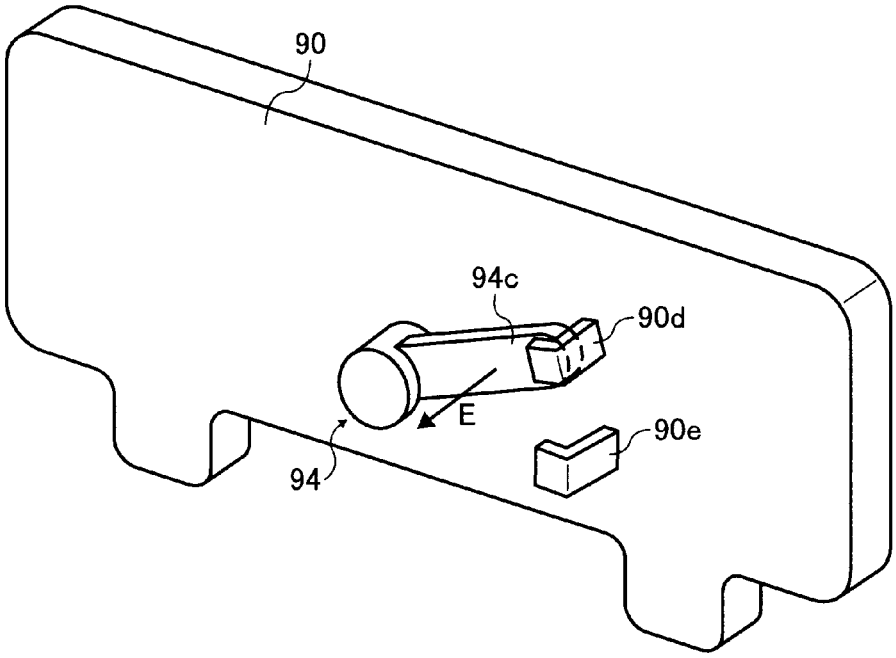
FIG. 24 is a perspective view for explaining how the operation lever and regulating members are arranged on the cover according to a second embodiment of the present invention.

A second embodiment of the present invention will be explained with reference to FIG. 24. The second embodiment aims to solve the third problem described above. The operation lever 94 is configured to be able to swing about the rotation shaft 94*a* (not shown in FIG. 24), like the operation lever shown in FIGS. 17 and 30. Also, regulating members 90*d* and 90*e* are integrally formed with the cover 90, the regulating members 90*d* and 90*e* being configured to regulate the movement of the operation lever 94 in the direction indicated by the arrow E along the rotation shaft 94*a*. Except for this difference, the second embodiment is the same as the second comparative example and the first embodiment.

Each of the regulating members 90*d* and 90*e* is in an L-shape in the cross section thereof. The regulating members 90*d* and 90*e* are integrally formed with the cover 90 at positions that are the farthest points between the center of the rotation shaft 94*a* (not shown in FIG. 24) and the tip of the handle unit 94*c* of the operation lever 94 and also that correspond to the top dead point and the bottom dead point of the swinging range of the operation lever 94. With this arrangement, the regulating members 90*d* and 90*e* are provided on the cover 90 that covers the positioning holding member 32 (not shown in FIG. 24) to prevent the operation lever 94 from moving in the direction indicated by the arrow E.

As explained above, according to the second embodiment, the regulating members 90*d* and 90*e* are provided so that the operation lever 94 is prevented from moving in the direction indicated by the arrow E. Thus, even if an operator who is not familiar with the operation of the apparatus operates the apparatus, it is possible to prevent the operation lever 94 from being damaged. In addition, because the regulating members 90*d* and 90*e* are provided at the positions that are the farthest points between the center of the rotation shaft 94*a* of the operation lever 94 to the tip of the handle unit 94*c*, it is possible to prevent the operation lever 94 from being damaged in a more secured manner and in the manner of a precaution.

Figure 25:
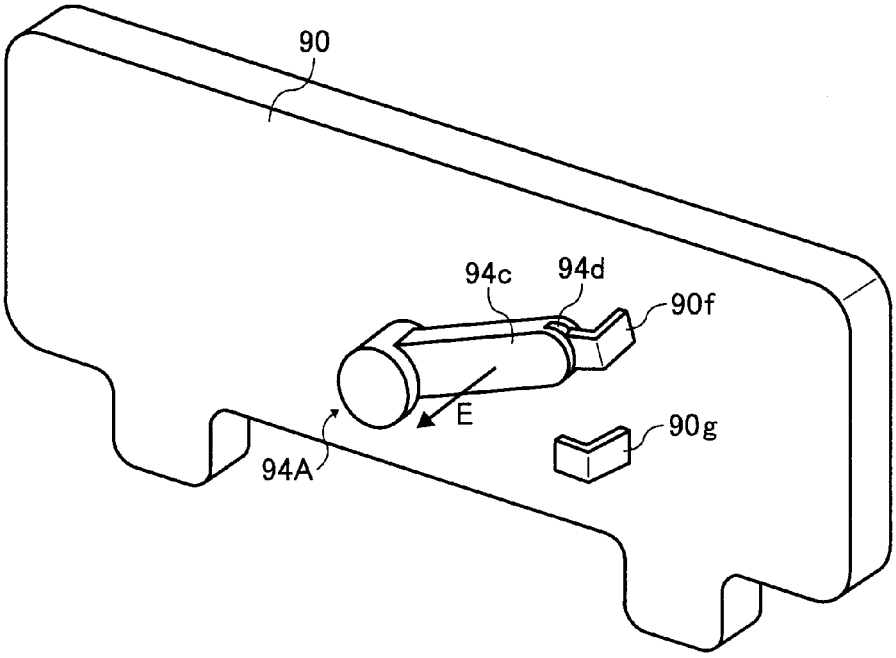
FIG. 25 is a perspective view for explaining how the operation lever and regulating members are arranged on the cover according to a modification of the second embodiment.

In FIG. 25, a modification of the second embodiment is shown. The modification shown in FIG. 25 is different from the second embodiment shown in FIG. 24 in that an operation lever 94A as an operating unit having, at the tip of the handle unit 94*c*, a notch 94*d* is used instead of the operation lever 94. Besides, regulating members 90*f* and 90*g* are integrally formed with the cover 90. The regulating members 90*f* and 90*g* are shaped to fit into and engage with the notch 94*d* in the operation lever 94A that regulate the movement of the operation lever 94A in the direction indicated by the arrow E along the rotation shaft 94*a*. Except for these differences, this modification is basically the same as the second embodiment.

The regulating members 90*f* and 90*g* are different from the regulating members 90*d* and 90*e* only in the height of the structure from the external surface of the cover 90. The rest is the same as the regulating members 90*d* and 90*e*. Accordingly, the regulating members 90*f* and 90*g* are provided on the cover 90 that covers the positioning holding member 32A (not shown in FIG. 25) so that the operation lever 94A is prevented from moving in the direction indicated by the arrow E.

As explained above, according to the modification shown in FIG. 25, the regulating members 90*f* and 90*g* are provided so that the operation lever 94A is prevented from moving in the direction indicated by the arrow E. Also, the regulating members 90*f* and 90*g* are provided at the positions that are farthest points between the center of the rotation shaft 94*a* and the tip of the handle unit 94*c* of the operation lever 94A. Thus, it is possible to achieve the same effect as in the second embodiment shown in FIG. 24.

In addition, because the notch 94*d* is provided at the tip of the handle unit 94*c* of the operation lever 94A, it is possible to keep the size of the regulating members 90*f* and 90*g* small. As a result, it is possible to prevent a situation where the operator's hand hits the regulating members 90*f* and 90*g* on the cover 90 when he/she operates the operation lever 94A. Accordingly, it is possible to improve the feel during the operation of the apparatus.

Figure 26:
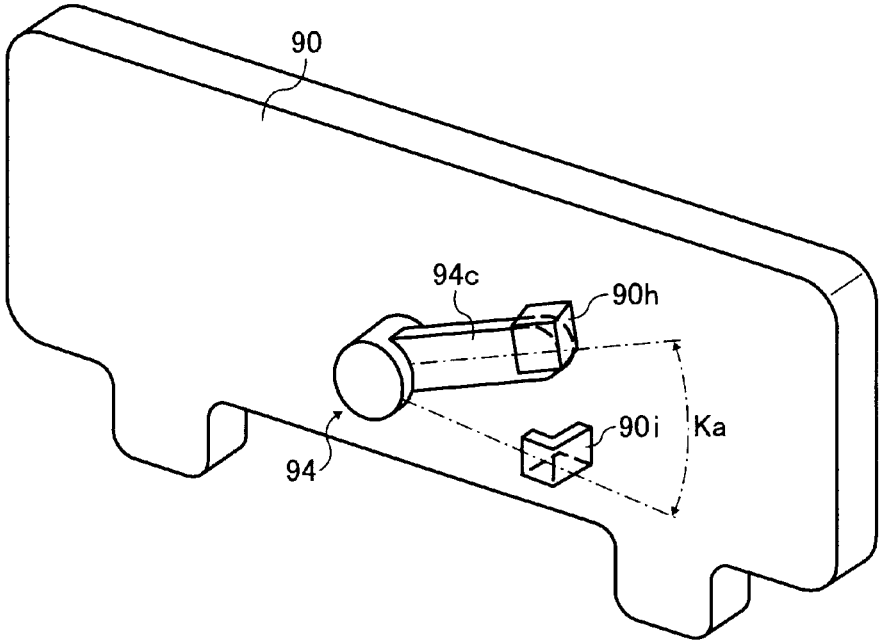
FIG. 26 is a perspective view for explaining how the operation lever and regulating members are arranged on the cover according to another modification than the one shown in FIG. 25.
Figure 27:
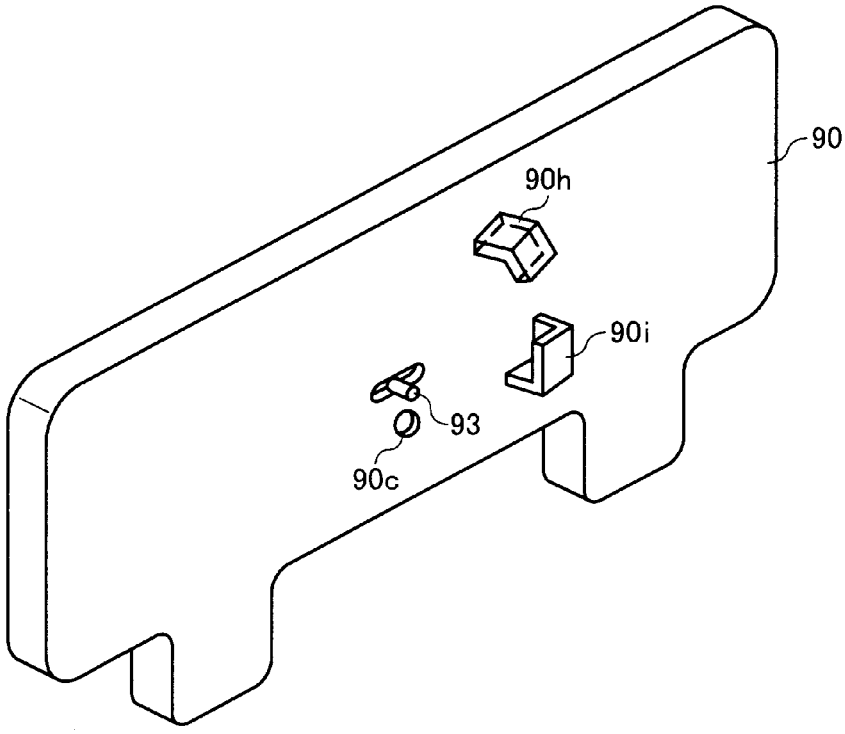
FIG. 27 is a perspective view in which the operation lever in the modification shown in FIG. 26 is not shown.

In FIGS. 26 and 27, another modification of the second embodiment is shown. In FIG. 27, a situation in which the operation lever 94 has been removed is shown, and the operation lever is omitted from the drawing. The modification shown in FIGS. 26 and 27 is different from the second embodiment shown in FIG. 24 in that regulating members 90*h* and 90*i* are integrally formed with the cover 90 instead of the regulating members 90*d* and 90*e*, the regulating members 90*h* and 90*i* being shaped to regulate a predetermined swinging range Ka of the operation lever 94. Except for this difference, this modification is the same as the second embodiment. According to this modification, the regulating members 90*h* and 90*i* are provided on the cover 90 that covers the positioning holding member 32A (not shown in FIGS. 26 and 27) to prevent the operation lever 94 from moving in the direction indicated by the arrow E and also to regulate the swinging range Ka of the operation lever 94.

As explained above, according to the modification shown in FIGS. 26 and 27, the regulating members 90*h* and 90*i* are provided so that the operation lever 94 is prevented from moving in the direction indicated by the arrow E. Also, the regulating members 90*h* and 90*i* are provided at the positions that are the farthest points between the center of the rotation shaft 94*a* and the tip of the handle unit 94*c* of the operation lever 94. Thus, it is possible to achieve the same effect as in the second embodiment.

In addition, because the regulating members 90*h* and 90*i* also regulate the swinging range of the operation lever 94, it is possible to prevent the operator from swinging the operation lever 94 too much and damaging the operation lever 94, in the manner of a precaution.

Figure 28:
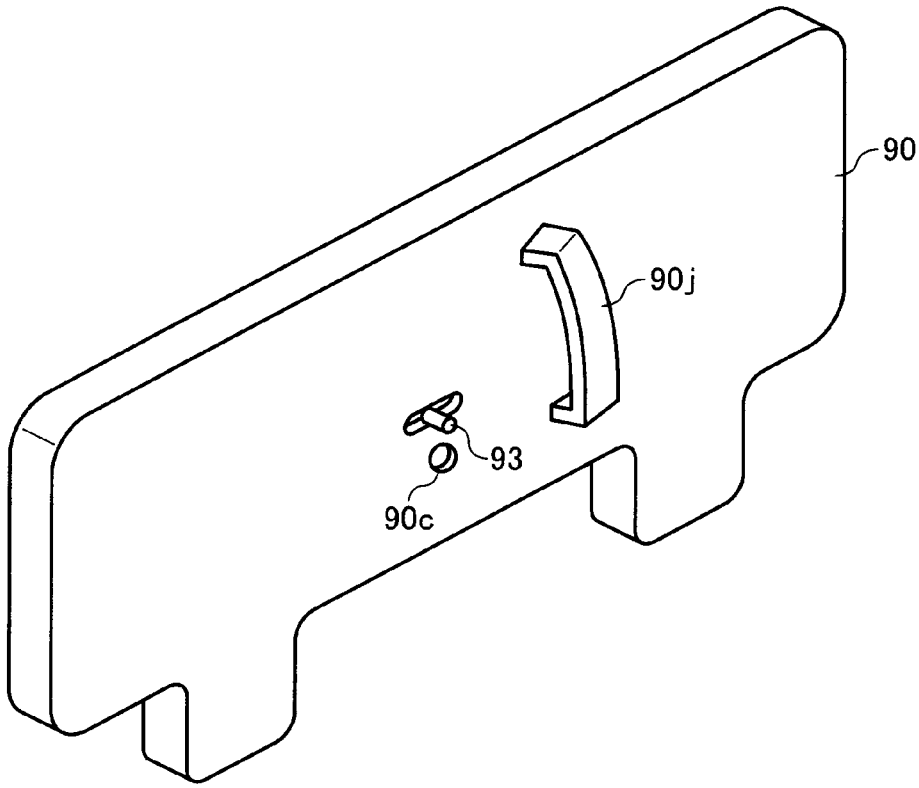
FIG. 28 is a perspective view for explaining how the operation lever and a regulating member are arranged on the cover according to yet another modification than the ones shown in FIGS. 25 and 26 in which the operation lever is not shown.

In FIG. 28, another modification obtained by modifying the modification shown in FIGS. 26 and 27 is shown. In FIG. 28, a situation in which the operation lever 94 has been removed is shown, and the operation lever is omitted from the drawing. The modification shown in FIG. 28 is different from the modification shown in FIGS. 26 and 27 in that a regulating member 90*j* is integrally formed with the cover 90 instead of the regulating members 90*d* and 90*e*, the regulating member 90*j* being formed so as to extend through an entire area of the predetermined swinging range Ka of the operation lever 94. Except for this difference, this modification is the same as the modification shown in FIGS. 26 and 27. According to this modification, the regulating member 90*j* is provided on the cover 90 that covers the positioning holding member 32A (not shown in FIG. 28) to prevent the operation lever 94 from moving in the direction indicated by the arrow E and also to regulate the entire area of the swinging range Ka of the operation lever 94.

As explained above, according to the modification shown in FIG. 28, the regulating member 90*j* is provided so that the operation lever 94 is prevented from moving in the direction indicated by the arrow E. Also, the regulating member 90*j* is provided at the position that is the farthest point between the center of the rotation shaft 94*a* and the tip of the handle unit 94*c* of the operation lever 94. Further, the regulating member 90*j* also regulates the swinging range of the operation lever 94. Thus, it is possible to achieve the same effect as in the modification shown in FIGS. 26 and 27.

In addition, because the regulating member 90*j* is provided on the cover 90 for the positioning holding member 32A so as to extend through the entire area of the swinging range of the operation lever 94, so that the operation lever 94 is prevented from moving in the direction indicated by the arrow E, it is possible to achieve an effect where the operation lever 94 is prevented from being damaged, even if an operator pulls the operation lever 94 in the direction indicated by the arrow E during the swinging operation.

Figure 29A:
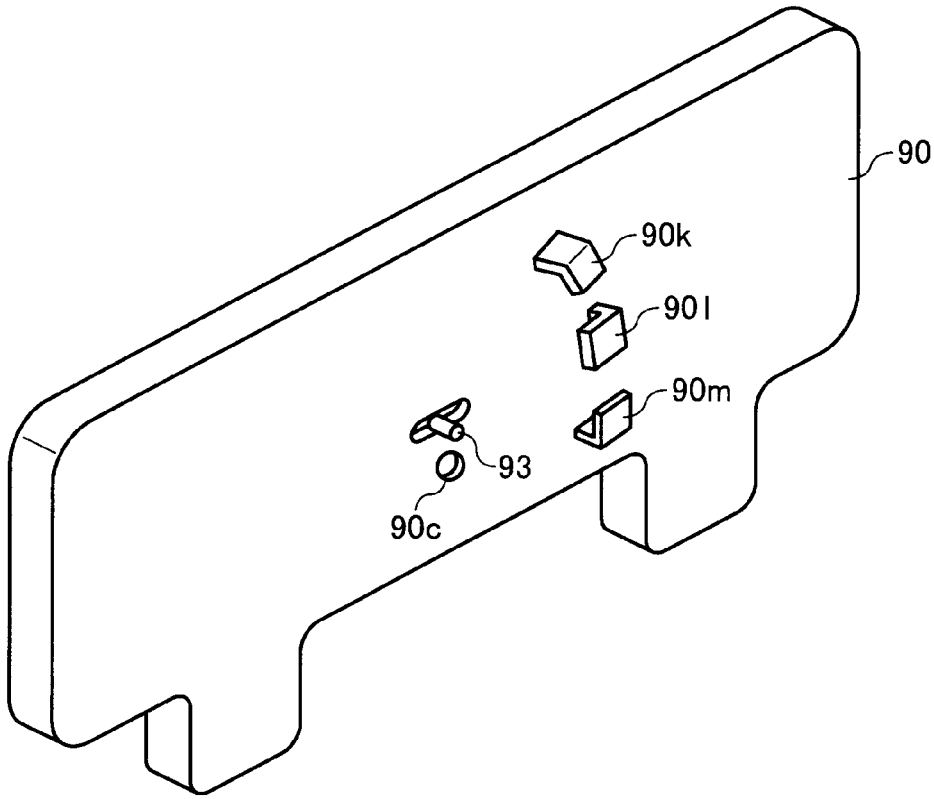
FIG. 29A is a perspective view for explaining how the operation lever and regulating members are arranged on the cover according to yet another modification than the ones shown in FIGS. 25 to 28 in which the operation lever is not shown.
Figure 29B:
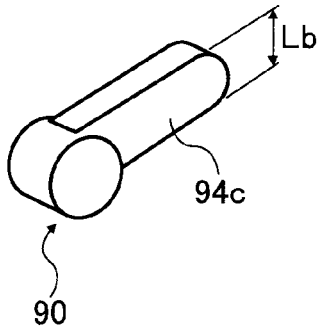
FIG. 29B is a perspective view for explaining the width of the operation lever.

In FIGS. 29A and 29B, another modification obtained by modifying the modification shown in FIG. 28 is shown. Also in FIG. 29A, a situation in which the operation lever 94 has been removed is shown, and the operation lever is omitted from the drawing. The modification shown in FIGS. 29A and 29B is different from the modification shown in FIG. 28 in that regulating members 90*k*, 90*l*, and 90*m* are integrally formed with the cover 90 instead of the regulating member j. The regulating members 90*k*, 90*l*, and 90*m* are located in parts of the predetermined swinging range of the operation lever 94 and, as shown in FIG. 29B, the distance between any two of the regulating members 90*k*, 90*l*, and 90*m* adjacent to each other is set to be smaller than the width Lb of the operation lever 94. Except for these differences, this modification is basically the same as the modification shown in FIG. 28. According to this modification, the regulating members 90*k*, 90*l*, and 90*m* are provided on the cover 90 that covers the positioning holding member 32A (not shown in FIG. 29A) to prevent the operation lever 94 (not shown in FIG. 29A) from moving in the direction indicated by the arrow E and also to regulate almost the entire area of the swinging range Ka of the operation lever 94.

As explained above, according to the modification shown in FIGS. 29A and 29B, the regulating members 90*k*, 90*l*, and 90*m* are provided so that the operation lever 94 is prevented from moving in the direction indicated by the arrow E. Also, the regulating members 90*k*, 90*l*, and 90*m* are provided at the positions that are the farthest points between the center of the rotation shaft 94*a* and the tip of the handle unit 94*c* of the operation lever 94. Further, the regulating members 90*k*, 90*l*, and 90*m* also regulate the swinging range of the operation lever 94. Thus, it is possible to achieve the same effect as in the modification shown in FIG. 28.

In addition, because the regulating members 90*k*, 90*l*, and 90*m* are provided on the cover 90 for the positioning holding member 32A and located in the parts of the swinging range, so that the operation lever 94 is prevented from moving in the direction indicated by the arrow E, and also because the distance between any two of the regulating members 90*k*, 90*l*, and 90*m* that are positioned adjacent to each other is set to be smaller than the width Lb of the operation lever 94, it is possible to achieve an effect where the operation lever 94 is prevented from being damaged, even if an operator pulls the operation lever 94 in the direction indicated by the arrow E during the swinging operation.

The regulating members 90*d* to 90*m* according to the second embodiment and the modifications shown in FIGS. 24 to 29 do not have to be integrally formed with the cover 90. If it is not necessary to achieve the advantageous effect of keeping the cost low by integrally forming the regulating members with the cover 90, another arrangement is acceptable in which the regulating members are provided separately from the cover 90 and fixed by an appropriate fastening unit, adhered, or thermally fused together.

Third Embodiment

Figure 30:
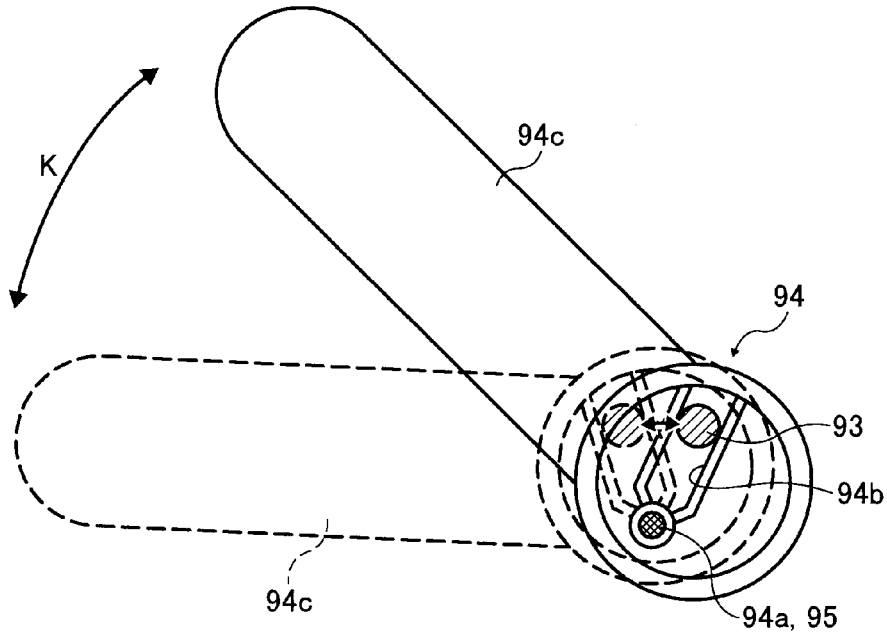
FIG. 30 is a schematic for explaining a movement of the operation lever that is more similar to the one according to the embodiment than the one shown in FIG. 18.
Figure 31:
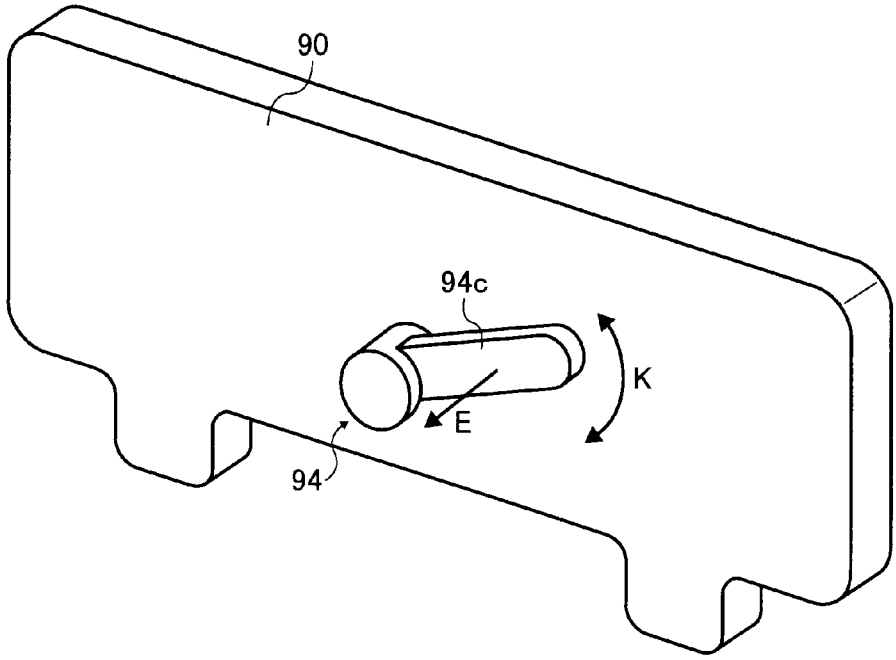
FIG. 31 is a perspective view for explaining how the operation lever that is more similar to the one according to the embodiment than that shown in FIGS. 17 and 18 is arranged on the cover.
Figure 32:
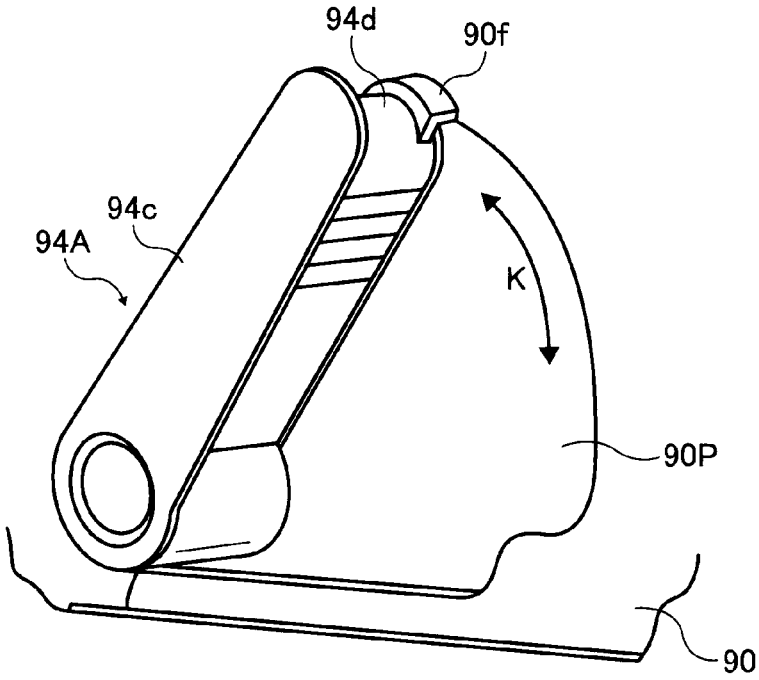
FIG. 32 is a perspective view for explaining how the operation lever that is more similar to the one according to the embodiment than that shown in FIG. 25 is arranged on the cover.

A third embodiment of the present invention aims to solve the fourth problem where, when the operation lever 94 shown in FIGS. 30 to 32 is operated incorrectly by an operator who is not familiar with the operation of the apparatus or an unspecified person, the positioning of the process cartridges (the image carrier units) 1Y, 1C, 1M, and 1BK performed by the positioning unit 70 shown in FIG. 8 is cancelled suddenly or unexpectedly or becomes insufficient.

As explained in the description of the second comparative example and the first and the second embodiments, when the positioning unit 70 is closed on the image forming apparatus 7 to be attached and set, the attachment holes 77 in the positioning holding member 32A hold the bearings 17 for the process cartridges 1Y, 1C, 1M, and 1BK in such a manner that the bearings 17 are scooped up from underneath. In this situation, the sliding member 41A that includes the pressing units shown in FIGS. 8 and 17 operates so that the pressing members 44A press the bearings 17 for the process cartridges 1Y, 1C, 1M, and 1BK. Accordingly, the process cartridges 1Y, 1C, 1M, and 1BK are positioned via the photosensitive drums.

The pressing units are joined to the operation lever 94 or 94A that serves as an operating unit. In this example, when the operation lever 94A shown in FIG. 32 is swung in the direction indicated by the arrow K (in the up-and-down direction), it becomes possible to activate and deactivate the positioning action. The operation lever 94A shown in FIG. 32 provides a more specific view than the operation lever 94A shown in FIG. 25. In FIG. 32, the reference character 90P refers to a recessed portion that is integrally formed with the cover 90 to define the swinging range of the operation lever 94A in the direction indicated by the arrow K.

Figure 33:
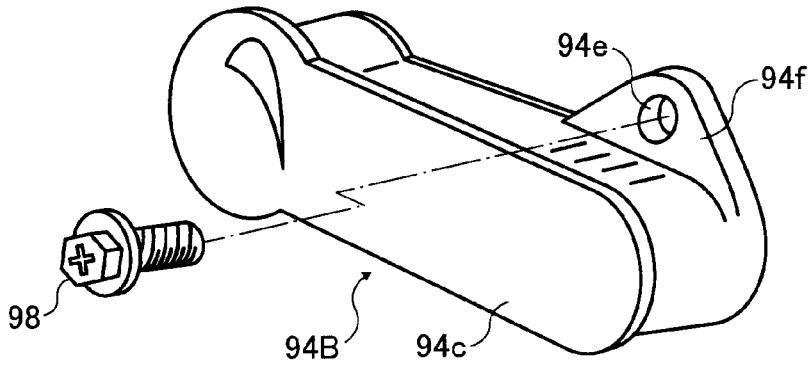
FIG. 33 is a perspective view of a relevant part of a fixing unit for an operation lever according to a third embodiment of the present invention.

The third embodiment is characterized in that a fixing unit for fixing an operating unit is provided. As shown in FIG. 33, an operation lever 94B that serves as the operating unit is integrally formed with the handle unit 94*c* to serve also as a fixing unit that fixes the operation lever 94B itself when being used in place of, for example, the operation lever 94A. The operation lever 94B also includes a fixing unit 94*f* having an attachment hole 94*e* to be fixed with a deformed screw 98. The third embodiment is different from the second embodiment only in that the operation lever 94B including the fixing unit for fixing the operation lever 94B itself and the deformed screw 98 are used. Except for these differences, the third embodiment is the same as the second embodiment.

When the operation lever 94A is incorrectly operated by an unidentified person, a problem may arise where the positioning is insufficiently performed. However, when the operation lever 94B including the fixing unit is used so that the swinging movement of the operation lever 94 can be enabled, the operations will be performed only those who have learned how to operate the apparatus, and the problem above will be solved. This arrangement is especially effective with apparatuses for which product maintenance contracts have been signed and maintained under the contracts.

According to the third embodiment, by fixing the operation lever 94B (the operating unit) on the positioning unit, using the deformed screw 98 or the like, it is possible to prevent the apparatus from being carelessly released from the pressed state (or the positioned state).

Figure 34:
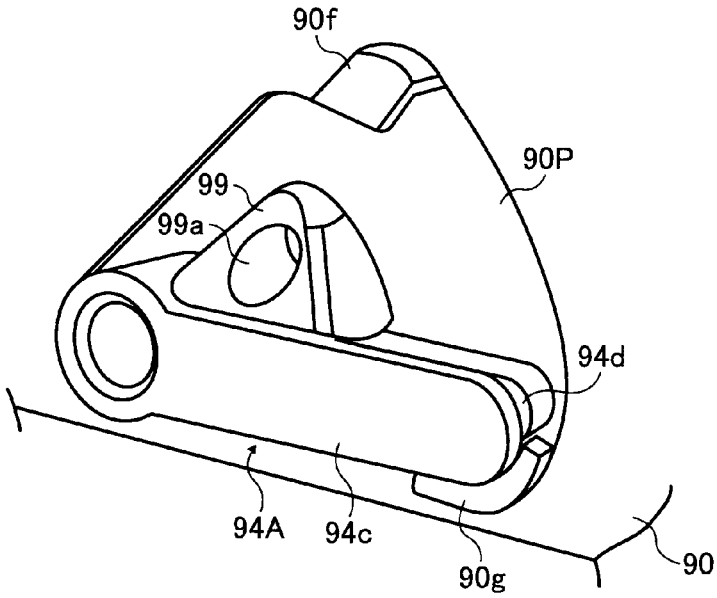
FIG. 34 is a perspective view of a relevant part of an independent fixing unit for the operation lever according to a modification of the third embodiment.
Figure 35:
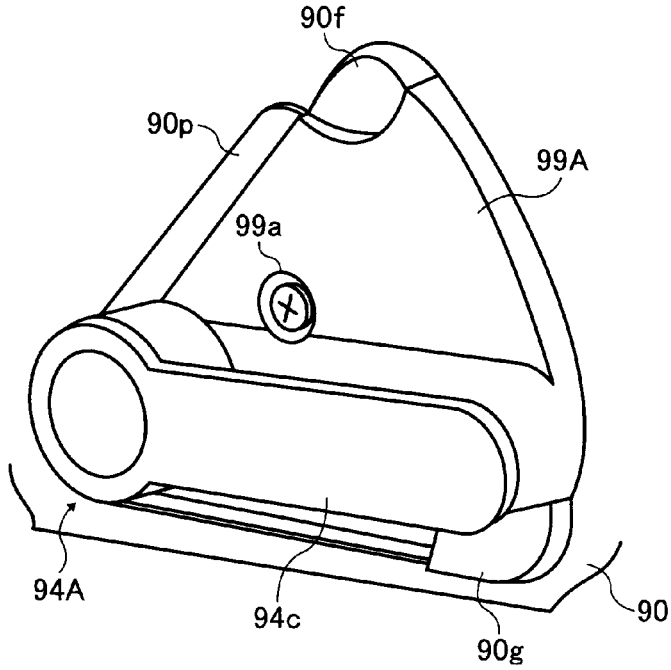
FIG. 35 is a perspective view of a relevant part of an independent fixing unit for the operation lever according to another modification than the one shown in FIG. 34.

In FIGS. 34 and 35, modifications of the third embodiment are shown. The modifications shown in FIGS. 34 and 35 aim to apply the present invention widely even to some models of image forming apparatuses that allow operators to operate the apparatuses freely. The modifications shown in FIGS. 34 and 35 are obtained by arranging the image forming apparatus according to the second comparative example, the first and the second embodiments, or the like so that the fixing unit for fixing the operating unit is an independent structure.

A fixing member 99 having a screw attachment hole 99*a* is used as a fixing unit that fixes the operation lever 94A shown in FIG. 34 so that while the sliding member 41A in the positioning unit 70 is placed in the second position (the pressing state) by using the operation lever 94A, the fixing unit fixes the operation lever 94A independently and separately.

Likewise, a fixing member 99A having the screw attachment hole 99*a* is used as a fixing unit that fixes the operation lever 94A shown in FIG. 35 so that while the sliding member 41A in the positioning unit 70 is placed in the second position (the pressing state) by using the operation lever 94A, the fixing unit fixes the operation lever 94A independently and separately.

According to this modification, if no product maintenance contract has been signed for an image forming apparatus and no after-sale service is required, it will be appropriate not to include the fixing unit shown in FIGS. 34 and 35 as standard equipment so that the owner of the apparatus has the full right to operate the apparatus.

According to this modification, because the fixing member 99 or 99A (an independent fixing unit) that is separate from and independent of the operation lever 94A (the operating unit) on the positioning unit is used for fixing the operation lever 94A, it is possible to apply the present invention widely even to some models of image forming apparatuses that allow operators to operate the apparatuses freely.

With regard to the modifications shown in FIGS. 34 and 35, an example that aims to improve the levels of assembly performance and maintenance will be explained.

In this example, the image forming apparatus according to the second comparative example, the first and the second embodiments, or the like is arranged so that the fixing unit is positioned above the operating unit.

In the modifications shown in FIGS. 34 and 35, by arranging the fixing member 99 or 99A that is separate from and independent of the operation lever 94A so that the fixing member 99 or 99A is positioned above the operation lever 94A, it is possible to prevent an operator from dropping the fixing unit when attaching and detaching the fixing unit and also allow the operator to temporarily position the fixing unit when fastening it. In addition, before the actual operation, it is possible to achieve an effect where the operator intuitively recognizes that he/she cannot move the operating unit when the fixing unit and the operating unit appear to be joined to each other so that sense of unity is developed.

Thus, according to this example, it is possible to prevent an operator from losing the fixing unit, which is an independent structure, when attaching and detaching the fixing unit.

Next, with regard to the third embodiment shown in FIG. 32 and the modifications shown in FIGS. 34 and 35, an example that aims to help an operator intuitively recognize the positioning unit does not move will be explained.

In this example, as partially explained above, the image forming apparatus according to the second comparative example, the first and the second embodiments, or the like is arranged so that the operating unit and the fixing unit that fixes the operating unit have an external appearance as if they were joined to each other.

Thus, according to this example, it is possible to make a person who is not familiar with the apparatus recognize that the operating unit does not move. Consequently, it is possible to prevent incorrect operations that are performed unexpectedly.

Next, with regard to the third embodiment shown in FIG. 32 and the modifications shown in FIGS. 34 and 35, an example that aims to limit the right to attach and detach the fixing unit to one or more specified persons will be explained.

In this example, the image forming apparatus according to the second comparative example, the first and the second embodiments, or the like is arranged so that a special tool needs to be used for attaching and detaching the fixing unit.

An example in which the fixing unit in the third embodiment shown in FIG. 32 or the modifications shown in FIGS. 34 and 35 is to be removed, when necessary, so that the operation lever 94A can be operated will be explained.

By using the special deformed screw 98 or the like, which is low in versatility, for fastening the operation lever 94B (the fixing unit) shown in FIG. 33 and for the fixing member 99 or 99A that is shown in FIG. 34 or 35, and also by allowing designated workers to use a corresponding tool, it is possible to make the maintenance management enhanced and thorough.

Thus, according to this example, it is possible to prevent troubles caused in the apparatus by unexpected operations, because those who are able to attach and detach the fixing unit are limited to the specified workers.

Next, with regard to the third embodiment shown in FIG. 32 and the modifications shown in FIGS. 34 and 35, an example that aims to disclose information that is necessary to perform the operation without fail when the operation is performed on the fixing unit on the inside of the apparatus.

In this example, the image forming apparatus according to the second comparative example, the first and the second embodiments, or the like is arranged so that information related to the apparatus is written near a position at which the fixing unit for the positioning unit is provided. According to this example, it is possible to call attention to an operation to be performed next, by presenting new information to the operator, including information regarding how to treat the operating unit or the image carriers that are hidden behind the fixing unit.

Thus, according to this example, it is possible to realize the operations performed without fail inside the apparatus, including the operation on the operating unit without fail and proper treatment of the image carriers inside the apparatus.

Next, with regard to the third embodiment shown in FIG. 32 and the modifications shown in FIGS. 34 and 35, an example that aims to achieve the operation performed without fail on the fixing unit inside the apparatus will be explained.

In this example, the image forming apparatus according to the second comparative example, the first and the second embodiments, or the like is arranged to include a detecting unit that detects a state in which the operating unit is fixed by the fixing unit.

Figure 36:
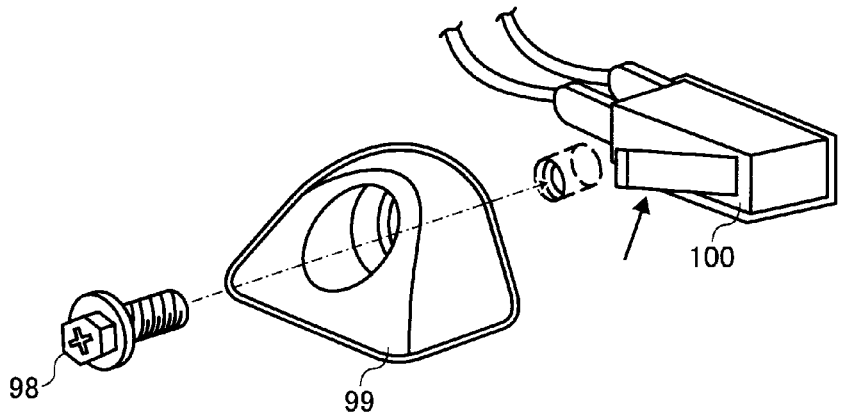
FIG. 36 is a perspective view of a relevant part including the operation lever, the fixing unit, and a detecting unit according to yet another modification than the ones shown in FIGS. 34 and 35.

As shown in FIG. 36, by providing, for example, an interlock switch that serves as a detecting unit 100 to detect the state in which the fixing member 99 (the fixing unit) is fixed with the deformed screw 98, even if the operator forgets to fasten or fix the fixing member 99 after a series of operations, it is possible to detect the situation by using the detecting unit 100 and to issue an alert (for example, turn on a buzzer on an operation panel or turn on the light or flashing the light in a light emitting diode (LED)). As a result, it is possible to position and fix the operation lever 94A, without fail, with respect to the cover 90 for the positioning unit by using the fixing member 99.

According to this example, after the operation is performed inside the image forming apparatus on the image carriers or the like, it is possible to make sure that the image forming apparatus returns to the state before the operation, without fail.

Next, with regard to the third embodiment shown in FIG. 32 and the modifications shown in FIGS. 34 and 35, an example that aims to prevent the entire positioning unit from being damaged and also to assure safety and maintain quality control will be explained.

In this example, the image forming apparatus according to the second comparative example, the first and the second embodiments, or the like is arranged so that the fixing unit restrains the entire positioning unit.

Figure 37:
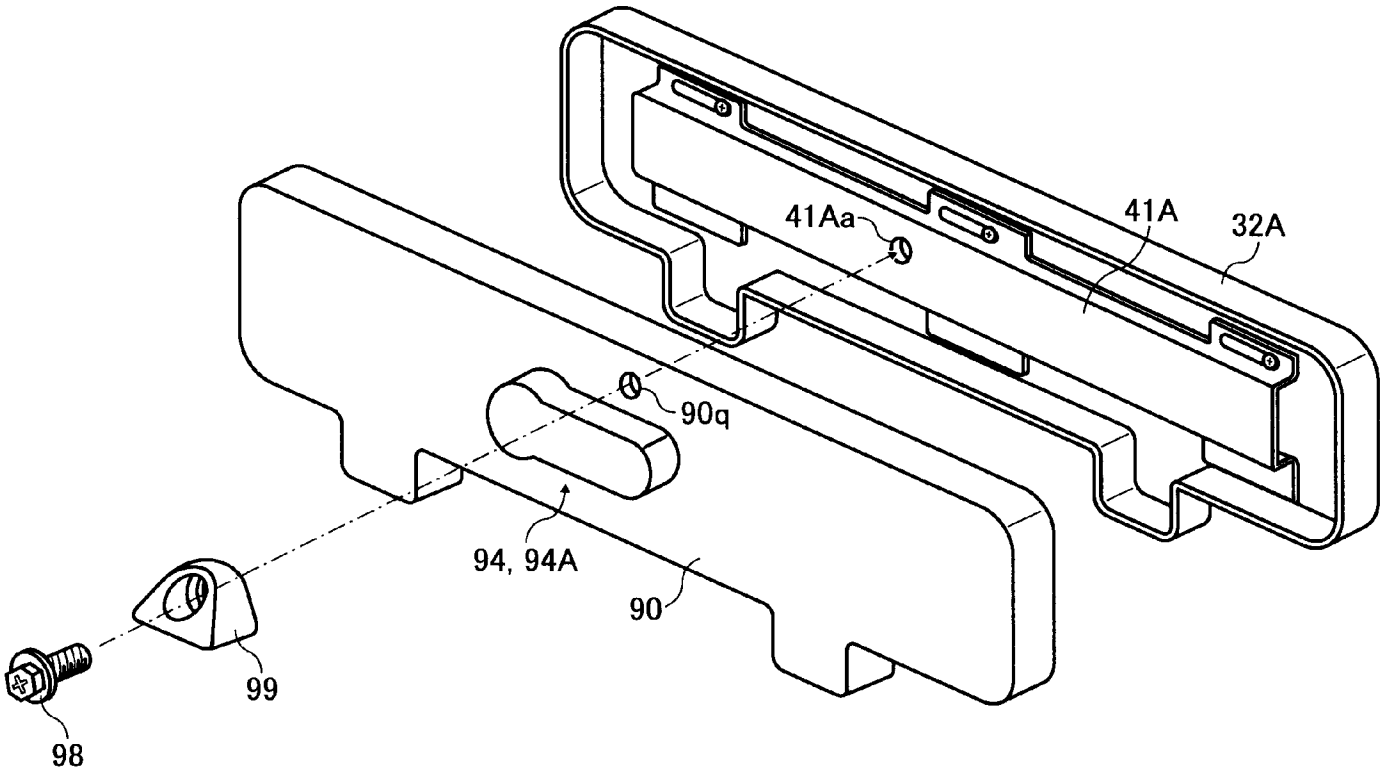
FIG. 37 is an exploded perspective view for explaining a modification in which the entire positioning unit is restrained.

As shown in FIG. 37, by having an arrangement in which the sliding member 41A that includes the pressing units is also fixed by the fixing member 99 via the deformed screw 98 or the like, the entire positioning unit 70 is restrained. Thus, it is possible to avoid or prevent a situation in which the sliding member 41A and the positioning unit 70 including the cover 90 are separated from each other and broken by an unexpected external force. In FIG. 37, the reference character 90*q* refers to an insertion hole that is provided in the cover 90 and is for the deformed screw 98 used for fixing the fixing member 99. The deformed screw 98 is to be screwed into an internal-thread hole 41Aa.

According to this example, because the fixing unit fixes all the constituent elements that are related to the movement inside the positioning unit, it is possible to maintain safety and quality for the entire positioning unit.

In the description of the comparative examples and the like, the examples refer to a tandem image forming apparatus by which, after images are transferred onto an intermediate transfer member, the images are collectively transferred to a sheet-like recording medium. However, it is possible to apply the present invention to a tandem color image forming apparatus that uses a direct transfer method by which images are sequentially transferred and overlapped while a sheet-like recording medium is conveyed by an endless belt serving as a recording medium conveying unit. An example of such an apparatus is shown in FIG. 1 in Japanese Patent Application Laid-open No. H11-95565. In other words, it is possible to apply the present invention to an image forming apparatus by which an image formed on at least one image carrier is transferred onto sheet-like recording medium directly or indirectly.

Further, it is possible to apply the present invention to an image forming apparatus that uses the positioning method for image carrier units disclosed in, for example, Japanese Patent Application Laid-open No. 2001-222207.

As set forth hereinabove, according to the embodiments of the present invention, the image forming apparatus includes the operating unit that is arranged on the cover at a position opposite to near the middle portion of the holding member in the longitudinal direction. Thus, when an operator performs the setting process with one hand, his/her hand is placed naturally at the position where a force should be applied. In addition, when a plurality of positioning members and a plurality of positioned members are used, it is effective to press the middle of the holding member via the cover. In this case also, the operator's hand is placed naturally at the position where a force should be applied during the setting process. Consequently, setting process can be facilitated even for an operator who is not familiar with the operation of the image forming apparatus.

Moreover, the cover includes the pressing position indicator at the position opposite to near the positioned member to assist engagement between the positioned member and the positioning member. Therefore, if the positioning unit and the cover slightly warp on either end thereof in the left-and-right direction (in the horizontal direction), the operator can apply a force effectively to the predetermined attachment position of the holding member as well as activating a locking device. Thus, it is possible to position and set the holding member (the positioning unit) with respect to the image forming apparatus without fail.

Furthermore, the operating unit is configured to be swingable about the rotation axis thereof. The regulating member on the cover regulates the movement of the operating unit along the rotation axis. Thus, even if an operator is not familiar with the operation of the image forming apparatus, it is possible to prevent the operating unit (for example, the operation lever) from being damaged. Additionally, the image forming apparatus includes the preventing unit that prevents the movement of the operating unit. Thus, it is possible to prevent the image forming apparatus from being carelessly released from the pressed state (positioned state).

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier unit that includes an image carrier and a carrier supporting member that supports the image carrier;

a positioning unit that is configured to open and close and to be attached to and detached from the image forming apparatus, and positions the image carrier unit via the carrier supporting member;

a positioning member that positions the positioning unit when the positioning unit is closed; and a positioned member that is located on the positioning unit and engages with the positioning member, wherein the positioning unit includes a holding member that includes an opening having a holding portion to hold the carrier supporting member when the positioning unit is closed and positioned in a predetermined position;

a pressing unit that presses and positions the carrier supporting member at the holding portion;

a cover that opposes the holding member via the pressing unit; and an operating unit that is used for operating the pressing unit and located on the cover at a position corresponding to be substantially at the center of the holding member in a longitudinal direction, and an image formed on the image carrier is transferred onto a recording medium directly or indirectly.

2. The image forming apparatus according to claim 1, wherein the operating unit is located on the cover at a position corresponding to near the positioned member.

3. The image forming apparatus according to claim 1, wherein the cover includes a pressing position indicator at a position corresponding to near the positioning member, the pressing position indicator being configured to assist engagement between the positioned member and the positioning member.

4. The image forming apparatus according to claim 1, further comprising a preventing unit that prevents movement of the operating unit.

5. An image forming apparatus comprising:

image carrier means including an image carrier and a carrier supporting member for supporting the image carrier;

first positioning means for positioning the image carrier unit via the carrier supporting member, the first positioning means being configured to open and close and to be attached to and detached from the image forming apparatus;

second positioning means for positioning the first positioning unit when the first positioning unit is closed; and positioned means that is located on the first positioning means and engages with the second positioning means, wherein the first positioning means includes holding means including an opening having a holding portion for holding the carrier supporting member when the first positioning means is closed and positioned in a predetermined position;

pressing means for pressing and positioning the carrier supporting member at the holding portion;

cover means that opposes the holding means via the pressing means; and operating means for operating the pressing means, the operating means being located on the cover at a position corresponding to be substantially at the center of the holding means in a longitudinal direction, and an image formed on the image carrier is transferred onto a recording medium directly or indirectly.

6. The image forming apparatus according to claim 5, wherein the operating means is located on the cover at a position corresponding to near the positioned means.

7. The image forming apparatus according to claim 5, wherein the cover includes a pressing position indicator means near the second positioning means for assisting engagement between the positioned means and the second positioning means.

8. The image forming apparatus according to claim 5, further comprising preventing means for preventing movement of the operating means.

9. The image forming apparatus according to claim 1, wherein the operating unit is arranged within a quarter of the length of the holding member in the longitudinal direction relative to the middle of the holding member in the longitudinal direction.

10. The image forming apparatus according to claim 5, wherein the operating means is arranged within a quarter of the length of the holding means in the longitudinal direction relative to the middle of the holding means in the longitudinal direction.

* * * * *